US006680089B2

(12) United States Patent
Miyake et al.

(10) Patent No.: US 6,680,089 B2
(45) Date of Patent: Jan. 20, 2004

(54) THERMAL TRANSFER SHEET

(75) Inventors: Kazuhito Miyake, Shizuoka (JP); Mitsuru Yamamoto, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 98 days.

(21) Appl. No.: 09/983,514

(22) Filed: Oct. 24, 2001

(65) Prior Publication Data

US 2002/0075228 A1 Jun. 20, 2002

(30) Foreign Application Priority Data

| | | |
|---|---|---|
| Oct. 26, 2000 | (JP) | P.2000-327474 |
| Jan. 17, 2001 | (JP) | P.2001-009088 |
| Oct. 1, 2001 | (JP) | P.2001-305398 |

(51) Int. Cl.[7] ..... B41M 5/40
(52) U.S. Cl. ..... 428/32.8; 428/32.81
(58) Field of Search ..... 428/195, 32.8, 428/32.81

(56) References Cited

FOREIGN PATENT DOCUMENTS

| | | |
|---|---|---|
| JP | 5-162470 A | 6/1993 |
| JP | 5-286257 A | 11/1993 |
| JP | 7-52538 A | 2/1995 |
| JP | 7-76164 A | 3/1995 |
| JP | 8-267916 | 10/1995 |
| JP | 9-175029 A | 7/1997 |
| JP | 11-348438 | 12/1999 |
| JP | 2000-1055 A | 1/2000 |
| JP | 2000-33780 | 2/2000 |

*Primary Examiner*—B. Hamilton Hess
(74) *Attorney, Agent, or Firm*—Sughrue Mion, PLLC

(57) ABSTRACT

To provide a thermal transfer sheet which is not affected by the illumination light source even in comparison with the pigment coloring material or printed matter and upon transfer of the coloring material thin film, ensures excellent sharpness of halftone dots, good sensitivity, reduced film fogging and very stable transfer releasability. A thermal transfer sheet comprising a support having provided thereon at least a light-to-heat conversion layer containing a light-to-heat conversion substance, and an image forming layer in this order, wherein the absolute value of the difference in the solubility parameter (SP values) obtained by the Okitsu' method between the binder in the image forming layer and the binder contained in the underlying layer thereof is 1.5 or more.

9 Claims, No Drawings

THERMAL TRANSFER SHEET

FIELD OF THE INVENTION

The present invention relates to a thermal transfer sheet for use in a multicolor image formation method of forming a high-resolution full color image using laser light. More specifically, the present invention relates to a thermal transfer sheet which can be used in a multicolor image formation method useful in the manufacture of a color proof (DDCP (direct digital color proof)) or a mask image in the printing field.

BACKGROUND OF THE INVENTION

In the field of graphic art, an image is printed on a printing plate using a set of color-separation films prepared from a color original by using lithographic films. In general, a color proof is manufactured from the color-separation films before the main printing (i.e., actual printing operation) so as to check on errors in the color separation process or whether color correction or the like is necessary. The color proof is demanded to have capabilities such as realization of high resolution for enabling the formation of a middle tone image with high reproducibility, and high process stability. Furthermore, in order to obtain a color proof approximated to an actual printed matter, the materials used for the actual printed matter are preferably used for the materials of the color proof, for example, the substrate is preferably the printing paper and the coloring material is preferably the pigment. With respect to the method for manufacturing the color proof, a dry process of using no developer solution is highly demanded.

For manufacturing the color proof by a dry process, a recording system of manufacturing a color proof directly from digital signals has been developed accompanying the recent widespread of an electronized system in the pre-printing process (pre-press field). This electronized system is developed particularly for the purpose of manufacturing a high-quality color proof and by this system, a halftone image of 150 lines/inch or more is generally reproduced. For recording a high-quality proof from digital signals, laser light capable of modulating by the digital signals and sharply focusing the recording light is used as the recording head. Accordingly, the recording material used with the laser is required to exhibit high recording sensitivity to the laser light and high resolution for enabling the reproduction of high definition halftone dots.

With respect to the recording material for use in the transfer image formation method utilizing laser light, a heat-fusion transfer sheet is known, where a light-to-heat conversion layer capable of generating heat upon absorption of the laser light and an image forming layer containing a pigment dispersed in a heat-fusible component such as wax or binder are provided on a support in this order (see, JP-A-5-58045 (the term "JP-A" as used herein means an "unexamined published Japanese patent application")). According to the image formation method using this recording material, heat is generated in a region irradiated with the laser light of the light-to-heat conversion layer and the image forming layer corresponding to the region is fused by the heat and transferred to an image receiving sheet disposed on the transfer sheet, whereby a transfer image is formed on the image receiving sheet.

JP-A-6-219052 discloses a thermal transfer sheet where a light-to-heat conversion layer containing a light-to-heat conversion substance, a very thin (0.03 to 0.3 $\mu$m) thermal releasing layer (i.e., thermal peeling layer) and an image forming layer containing a coloring material are disposed in this order on a support. In this thermal transfer sheet, upon irradiation with laser light, the bonding strength between the image forming layer and the light-to-heat conversion layer bonded with an intervention of the thermal releasing layer is diminished and a high definition image is formed on an image receiving sheet stacked and disposed on the thermal transfer sheet. This image formation method utilizes so-called "ablation", more specifically, a phenomenon such that a part of the thermal releasing layer in the region irradiated with the laser light is decomposed and vaporized and thereby the bonding strength between the image forming layer and the light-to-heat conversion layer is diminished in that region, as a result, the image forming layer in this region is transferred to an image receiving sheet stacked on the thermal transfer sheet.

The above-described image formation methods are advantageous in that a printing paper having provided thereon an image receiving layer (adhesive layer) can be used as the image receiving sheet material and a multicolor image can be easily obtained by sequentially transferring images of different colors to the image receiving sheet. In particular, the image formation method using ablation is advantageous in that a high definition image can be easily obtained and therefore, this method is useful for the manufacture of a color proof (DDCP (direct digital color proof)) or a high definition mask image.

In the transfer image formation method, the light-to-heat conversion layer reaches a high temperature upon irradiation of laser light and for improving the thermal resistance of the light-to-heat conversion layer, 1) a thermal transfer recording material using a resin having a Tg of 100° C. or more for the light-to-heat conversion layer (see, JP-A-11-348438), 2) a thermal transfer recording material using a resin having a thermal decomposition temperature of 360° C. or more (see, JP-A08-267916), 3) a thermal transfer recording layer using a crosslinked resin for the light-to-heat conversion layer (see, JP-A-2000-033780) and the like have been proposed. However, these thermal transfer recording layers using such a resin for the light-to-heat conversion layer have a limit in the elevation of sensitivity.

In particular, when high adhesive strength is present between the image forming layer and the underlying layer thereof of the thermal transfer sheet, the separation (i.e., peeling) from the underlying layer cannot be easily attained at the transfer for forming a transfer image on an image receiving sheet and this incurs not only insufficient sensitivity of the transferred image but also easy occurrence of layer fogging.

SUMMARY OF THE INVENTION

The object of the present invention is to solve the above-described problems in conventional techniques and provide a thermal transfer sheet which is not affected by the illumination light source even in comparison with the pigment coloring material or printed matter and upon transfer of the coloring material thin film, ensures excellent sharpness of halftone dots, good sensitivity, reduced layer fogging and very stable transfer releasability.

In the CTP (computer to plate) times, a film-less processing is used and a contract proof taking the place of proof print or color art is necessary. For attaining acknowledgement of users, color reproducibility agreeing with the printed matter or color art is required and in order to meet this requirement, a DDCP system using a coloring material of the same pigment as the printing ink, enabling transfer to the printing paper and being free of moire and the like has been developed. The target is a large-size (A2/B2) digital direct color proof system enabling transfer to the printing paper, using a coloring material of the same pigment as the printing ink and ensuring high approximation to the printed matter. The thermal transfer sheet of the present invention is mainly used in the method where a laser thin film thermal transfer system is employed, a pigment coloring material is used and transfer to the printing paper can be attained by performing actual halftone recording.

As a result of various investigations on the prevention of layer fogging or elevation of sensitivity of the thermal transfer recording material, the present inventors have found that when binders each having a solubility parameter (SP value) falling within a specific range are used in combination and contained in respective layers of the thermal transfer sheet, an excellent effect can be obtained in the prevention of layer fogging or the elevation of sensitivity. In particular, with respect to the prevention of layer fogging, when the difference in the SP value obtained by the Okitsu's method between the binders contained in the image forming layer and the underlying layer thereof of a thermal transfer sheet falls within a specific range, the adhesive strength of the image forming layer to the underlying layer thereof is diminished and the image can be smoothly transferred. With respect to the elevation of sensitivity, although the absorbance of the laser wavelength varies depending on the combination of a light-to-heat conversion substance and a binder contained in the light-to-heat conversion layer, when a water-insoluble light-to-heat conversion substance is combined with a binder having a solubility parameter (SP value) obtained by the Hoy's method within a specific range, the absorbance of the light-to-heat conversion layer is elevated and the sensitivity is improved. The present invention has been accomplished based on these findings.

That is, the means for solving the above-described problems include the followings.

<1> A thermal transfer sheet comprising a support having provided thereon at least a light-to-heat conversion layer containing a light-to-heat conversion substance, and an image forming layer in this order, wherein the absolute value of the difference in the solubility parameter (SP values) obtained by the Okitsu's method between the binder in the image forming layer and the binder contained in the underlying layer thereof is 1.5 or more.

<2> The thermal transfer sheet as described in <1>, wherein the light-to-heat conversion layer contains a water-insoluble light-to-heat conversion substance and a binder and the binder has a solubility parameter (SP value) obtained by the Hoy's method of 19.5 to 24.5.

<3> The thermal transfer sheet as described in <1>or <2>, wherein an interlayer is provided between the light-to-heat conversion layer and the image forming layer.

<4> The thermal transfer sheet as described in <1>or <2>, wherein the image forming layer contains a pigment and an amorphous organic high molecular polymer having a softening point in the temperature range of from 40 to 150° C. as a binder each in an amount of 20 to 80% by weight and has a thickness of 0.2 to 1.5 $\mu$m.

<5> The thermal transfer sheet as described in <1>or <2>, wherein the light-to-heat conversion layer contains at least one polymer mordant together with the light-to-heat conversion substance.

<6> The thermal transfer sheet as described in <1>or <2>, wherein the light-to-heat conversion substance gives a maximum absorbance at a wavelength of 700 to 1,200 nm in the light-to-heat conversion layer.

<7> The thermal transfer sheet as described in <1>, <2>or <6>, wherein the light-to-heat conversion substance is an infrared absorbing dye.

<8> The thermal transfer sheet as described in <7>, wherein the infrared absorbing dye is a cyanine dye.

<9> The thermal transfer sheet as described in <1>or <2>, wherein the recording is performed at a scanning speed of 7 m/s or more using a laser having an output of 50 mW or more

DETAILED DESCRIPTION OF THE INVENTION

SP Value of Binder:

In the present invention, as the binder contained in each layer of the light-to-heat conversion layer and the image forming layer of the thermal transfer sheet, the binder having the solubility parameter (SP values) which is within a specific range is used.

The method for calculating the SP value of the binder includes a method using the Hoy's equation (see, K. L. Hoy, *Table of Solubility Parameters*, Solvent and Coatings Materials Research and Development Department, Union Carbides Corp (1985)) and a method using the Okitsu's equation (see, *Nippon Secchaku Gakkai Shi* (*Journal of Japan Adhesive Society*), Vol. 29, No. 5 (1993)).

In the present invention, the Sp values is calculated by the above Hoy's method or the Okitsu's method.

The thermal transfer sheet of the present invention including the image forming method using the thermal transfer sheet are explained in detail below.

The thermal transfer sheet of the present invention is effective and suitable for a system where a thermal transfer image formed of sharp dots is realized and transfer to the printing paper and B2-size recording (515 mm×728 mm, provided that B2 size is 543 mm×765 mm) can be performed.

This thermal transfer image can be a halftone image according to the printing line numbers with a resolution of 2,400 dpi or more. Individual dots are almost free of blurring or missing and favored with a very sharp shape and therefore, dots over a wide range of from highlight to shadow can be clearly formed. As a result, high-level dots can be output with the same resolution as in the image setter or CTP setter and the reproduced halftone dot and gradation can have good approximation to the printed matter.

Furthermore, this thermal transfer image is favored with a sharp dot shape and therefore, halftone dots responding to a laser beam can be faithfully reproduced. Also, since this thermal transfer image has recording characteristics such that the dependency on the environmental temperature and humidity is very small, the hue and the density both can be stably and repeatedly reproduced under an environment over a wide range of temperature and humidity.

This thermal transfer image is formed using a colored pigment used in the printing ink and favored with good repeated reproducibility, so that high-precision CMS (color management system) can be realized.

Also, this thermal transfer image can have a hue almost completely agreeing with the hue such as Japan color or SWOP color, namely, the hue of printed matter, and therefore, the change in the viewing of colors accompanying the change of light source such as fluorescent lamp or incandescent lamp can be the same as on the printed matter.

Furthermore, since this thermal transfer image is favored with a sharp dot shape, fine lines of a fine letter can be sharply reproduced. The heat generated by the laser light does not diffuse in the plane direction but is transmitted to the transfer interface and the image forming layer is sharply broken at the interface between the heated part and the non-heated part. Accordingly, the thermal transfer sheet can be controlled in the reduction of the thickness of the light-to-heat conversion layer and the dynamic characteristics of the image forming layer.

In a simulation, the light-to-heat conversion layer is presumed to momentarily reach about 700° C. and if the film is thin, the layer is readily deformed or broken. If the deformation or breakage occurs, there arise problems, more specifically, the light-to-heat conversion layer is transferred to the image receiving layer together with the transfer layer or a non-uniform transfer image results. For obtaining a predetermined temperature, the light-to-heat conversion substance must be present in the film at a high concentration and this causes a problem, for example, the dye may precipitate or migrate to the adjacent layer.

Accordingly, the light-to-heat conversion layer is preferably reduced in the thickness to about 0.5 $\mu$m or less by selecting an infrared absorbing dye having excellent light-to-heat conversion property and a heat-resistant binder such as polyimide.

In general, if the light-to-heat conversion is deformed or the image forming layer itself is deformed by a high heat, the image forming layer transferred to the image receiving layer causes thickness unevenness corresponding to the pattern sub-scanned by laser light, as a result, a non-uniform image results and the apparent transfer density decreases. This tendency is more serious as the thickness of the image-forming layer is smaller. On the other hand, if the thickness of the image forming layer is large, the dot sharpness is impaired and at the same time, the sensitivity decreases.

In order to attain these contradictory performances at the same time, a low melting point substance such as wax is preferably added to the image forming layer to improve the transfer unevenness. Also, inorganic fine particles may be added in place of a binder to properly increase the layer thickness and thereby allow the image forming layer to sharply break at the interface between the heated part and the unheated part, so that the transfer unevenness can be improved while maintaining the dot sharpness and the sensitivity.

Generally, the low melting point substance such as wax has a tendency to bleed out to the surface of the image forming layer or undertake crystallization and in some cases, causes a problem in the image quality or the aging stability of the thermal transfer sheet.

For solving this problem, a low melting point substance having a small difference in the SP value from the polymer of the image forming layer is preferably used so as to elevate the compatibility with the polymer and prevent the separation of the low melting point substance from the image forming layer. Also, several kinds of low melting point substances different in the structure are preferably mixed to form an eutectic crystal and thereby prevent the crystallization. By employing this means, an image having a sharp dot shape and reduced in the unevenness can be obtained.

In general, when the coated layer of the thermal transfer sheet absorbs moisture, the layer is changed in the dynamic properties and thermal properties to generate temperature and humidity, dependency of the recording environment.

In order to reduce this temperature and humidity dependency, the dye/binder system of the light-to-heat conversion layer and the binder system of the image forming layer each is preferably an organic solvent system. In addition, combining with the selection of polyvinyl butyral as the binder of the image receiving layer, a polymer hydrophobitization technique is preferably introduced so as to reduce the water absorptivity of the binder. Examples of the polymer hydrophobitization technique include a technique of reacting a hydroxyl group with a hydrophobic group described in JP-A-8-238858 and a technique of crosslinking two or more hydroxyl groups by a hardening agent.

Usually, a heat of about 500° C. or more is applied to the image forming layer at the time of photographic printing by a laser exposure and some pigments conventionally used are thermally decomposed but this can be prevented by employing a highly heat-resistant pigment for the image forming layer.

Also, due to the high heat at the photographic printing, the light-to-heat conversion substance such as infrared absorbing dye migrates from the light-to-heat conversion layer into the image forming layer and the hue is changed. For preventing this, as described above, the light-to-heat conversion layer is preferably designed by using a combination of a light-to-heat conversion substance having high holding power and a binder.

At the high-speed photographic printing, a shortage of energy generally occurs and in particular, this generates gaps corresponding to the intervals of the laser sub-scanning. As described above, the elevation of the dye concentration in the light-to-heat conversion layer and the reduction in the thickness of the light-to-heat conversion layer/image forming layer can increase the efficiency of heat generation/transmission. Furthermore, for the purpose of providing an effect of allowing the image forming layer to slightly fluidize at the heating and thereby fill the gap and also elevating the adhesive property to the image forming layer, a low melting point substance is preferably added to the image-forming layer. In addition, for elevating the adhesive property between the image receiving layer and the image forming layer and ensuring a sufficiently high strength for the transferred image, the same polyvinyl butyral as, for example, in the image forming layer is preferably employed as the binder of the image receiving layer.

At the time of thermal transfer recording, the image receiving sheet and the thermal transfer sheet are preferably held on a drum by vacuum contact. This vacuum contact is important because the image is formed by controlling the adhesive strength of those two sheets and the image transfer behavior is very sensitive to the clearance on the image receiving layer surface of the image receiving sheet and the image forming layer surface of the transfer sheet. If a foreign matter such as dust triggers widening of the clearance between materials, image failure or image transfer unevenness is caused.

For preventing such image failure or image transfer unevenness, uniform asperities are preferably provided on the thermal transfer sheet so as to attain good passing of air and obtain uniform clearance.

For providing asperities on the transfer sheet, after-treatment such as embossing or addition of a matting agent is generally used, however, for simplifying the production process and stabilizing the material in aging, the addition of a matting agent is preferred. The matting agent must have a larger size than the thickness of the coated layer. If the matting agent is added to the image forming layer, the image in the area of allowing the presence of the matting agent is missed. Therefore, a matting agent having an optimal particle size is preferably added to the light-to-heat conversion layer. By adding as such, the image forming layer itself can have almost a uniform thickness and an image free of defects can be obtained on the image receiving sheet.

The absolute value of the difference between the surface roughness Rz on the image forming layer surface of the thermal transfer sheet and the surface roughness Rz on the surface of the back layer thereof is preferably 3.0 or less and the absolute value of the difference between the surface roughness Rz on the image receiving layer surface of the image receiving sheet and the surface roughness Rz on the surface of the back layer thereof is preferably 3.0 or less. By virtue of this construction, the image defects can be prevented, the transportation jamming of sheets can be prohibited and the dot gain stability can be improved.

The surface roughness Rz as used in the present invention means a ten-point average surface roughness corresponding to Rz (maximum height) defined by JIS B 0601 and this is determined as follows. A basic area part is extracted from the roughness curved surface and using this portion as the basic face, the distance between the average altitude of projections from highest to the fifth height and the average depth of troughs from the deepest to the fifth depth is input and converted. For the measurement, a probe-system three-dimensional roughness meter (Surfcom 570A-3DF) manufactured by Tokyo Seimitsu Co., Ltd. is used. The measured direction is longitudinal direction, the cut-off value is 0.08 mm, the measured area is 0.6 mm×0.4 mm, the feed pitch is 0.005 mm and the measurement speed is 0.12 mm/s.

From the standpoint of more improving the above-described effect, the absolute value of difference between the surface roughness Rz on the image forming layer surface of the thermal transfer sheet and the surface roughness Rz on the surface of the back layer thereof is preferably 1.0 or less and the absolute value between the surface roughness Rz on the image receiving layer surface of the image receiving sheet and the surface roughness Rz on the surface of the back layer thereof is preferably 1.0 or less.

In another embodiment, the image forming layer surface of the thermal transfer sheet and the surface of the back layer thereof and/or the front and back surfaces of the image receiving sheet preferably have a surface roughness Rz of 2 to 30 μm. By having such a construction, the image defects can be prevented, the transportation jamming of sheets can be prohibited and the dot gain stability can be improved.

The glossiness on the image forming layer of the thermal transfer sheet is preferably from 80 to 99.

The glossiness greatly depends on the smoothness on the surface of the image forming layer and affects the uniformity in the layer thickness of the image forming layer. With a high glossiness, the image forming layer can be uniform and this is suitable for uses of forming a highly precise image, however, if the smoothness is high, the resistance at the transportation becomes larger. Thus, the glossiness and the smoothness are in the trade-off relationship but these can be balanced when the glossiness is from 80 to 99.

In the formation of a multicolor image, the laser light used for the light irradiation is preferably multi-beam light, more preferably light of a multi-beam two-dimensional arrangement. The multi-beam two-dimensional arrangement means that on performing a recording by laser irradiation, a plurality of laser beams are used and the spot arrangement of these laser beams forms a two-dimensional plane arrangement comprising a plurality of rows along the main scanning direction and a plurality of lines along the sub-scanning direction.

By using laser light having a multi-beam two-dimensional arrangement, the time period necessary for the laser recording can be shortened.

Any laser light may be used without any limitation insofar as it is a multi-beam laser. For example, gas laser light such as argon ion laser light, helium-neon laser light and helium-cadmium laser light, solid-state laser light such as YAG laser light, or direct laser light such as semiconductor laser light, dye laser light and excimer laser light is used. Also, for example, a light beam converted into a half wavelength by passing the above-described laser light through a secondary higher harmonic device may be used. In the formation of a multicolor image, semiconductor laser light is preferred on considering the output power and the easiness in modulation.

In the method for forming a multicolor image using the thermal transfer sheet of the present invention, the laser light is preferably irradiated under the conditions such that the beam diameter is from 5 to 50 μm (particularly from 6 to 30 μm) on the light-to-heat conversion layer. Also, the output is preferably 50 mW or more an the scanning rate (linear velocity) is preferably 7 m/sec or more (particularly 10 m/sec or more).

In the multicolor image formation, the thickness of the image forming layer in the black thermal transfer sheet is preferably larger than that of the image forming layer in each of yellow, magenta and cyan thermal transfer sheets and is preferably from 0.5 to 0.7 μm. By constructing as such, the reduction in density due to transfer unevenness can be suppressed at the laser irradiation of the black thermal transfer sheet.

If the layer thickness of the image forming layer in the black thermal transfer sheet is less than 0.5 μm, the image density greatly lowers due to transfer unevenness on the recording at a high energy and a necessary image density as a proof of printing may not be obtained. This tendency is more conspicuous under high humidity conditions and the change in density depending on the environment comes out more strongly in some cases. On the other hand, if the layer thickness exceeds 0.7 μm, the transfer sensitivity lowers at the laser recording and poor fixing of small points or thinning of fine lines may result. This tendency is more conspicuous under low humidity conditions. Also, the resolution may be worsened in some cases. The layer thickness of the image forming layer in the black thermal transfer sheet is more preferably from 0.55 to 0.65 μm, still more preferably 0.60 μm.

Furthermore, it is preferred that the layer thickness of the image forming layer in the black thermal transfer sheet is from 0.5 to 0.7 μm and the layer thickness of the image forming layer in each of the yellow, magenta and cyan thermal transfer sheets is preferably from 0.2 μm to less than 0.5 μm.

If the layer thickness of the image forming layer in each of the yellow, magenta and cyan thermal transfer sheets is less than 0.2 μm, the density may lowers due to transfer unevenness at the laser recording, whereas if it is 0.5 μm or more, reduction in the transfer sensitivity or worsening of the resolution may occur. The layer thickness of the image forming layer in each of the yellow, magenta and cyan thermal transfer sheets is more preferably from 0.3 to 0.45 μm.

The image forming layer in the black thermal transfer sheet preferably contains carbon black. The carbon black preferably comprises at least two kinds of carbon blacks different in the staining power because the reflection density can be adjusted while keeping a constant P/B (pigment/binder) ratio.

The coloring power of carbon black is expressed by various methods and, for example, PVC blackness described in JP-A-10-140033 may be used. The PVC blackness is determined as follows. Carbon black is added to PVC (Polyvinyl Chloride) resin, dispersed by means of a twin roller and formed into a sheet and by setting the blackness of Carbon Black "#40" and "#45" produced by Mitsubishi Kagaku as Point 1 and Point 10, respectively, the blackness of the sample is evaluated by the judgement with an eye. Two or more carbon blacks different in the PVC blackness can be appropriately selected and used according to the use end.

The method for preparing a sample is specifically described below.

<Method for Preparing Sample>

In a 250 ml-volume Banbury mixer, 40% by weight of a sample carbon black is blended with LDPE (low-density polyethylene) resin and kneaded at 115° C. for 4 minutes. Blending Conditions:

| | |
|---|---|
| LDPE resin | 101.89 g |
| Calcium stearate | 1.39 g |
| Irganox 1010 | 0.87 g |
| Sample carbon black | 69.43 g |

Then, the kneaded material is diluted at 120° C. by a twin roller mill to a carbon black concentration of 1% by weight. Conditions in Manufacture of Diluted Compound:

| | |
|---|---|
| LDPE resin | 58.3 g |
| Calcium stearate | 0.2 g |
| Resin having blended therein 40% by weight of carbon black | 1.5 g |

The diluted compound was processed into a sheet form through a 0.3 mm-width slit and the obtained sheet is cut into chips and formed into a film of 65±3 μm on a hot plate at 240° C.

With respect to the method for forming a multicolor image, a multicolor image may be formed using, as described above, the thermal transfer sheet and repeatedly superposing a large number of image layers (an image forming layer having formed thereof an image) on the same receiving sheet. Also, a multicolor image may be formed by once forming an image on each image receiving layer of a plurality of image receiving sheets and re-transferring the images to printing paper or the like.

In the latter case, for example, a thermal transfer sheet having an image forming layer containing coloring agents having different hues from each other is prepared and four kinds (four colors: cyan, magenta, yellow and black) of laminates for image formation are individually produced by combining the thermal transfer sheet with an image receiving sheet. On each laminate, for example, laser light is irradiated through a color separation filter according to digital signals based on an image and subsequently, the thermal transfer sheet is separated (i.e., peeled) from the image receiving sheet to individually form a color separation image of each color on each image receiving sheet. Respective color separation images formed are sequentially stacked on a separately prepared actual support such as printing paper or on a support approximated thereto, whereby a multicolor image can be formed.

In the thermal transfer recording using laser light irradiation, the state of pigment, dye or image forming layer at the transfer is not particularly limited insofar as a laser beam can be converted into heat, the image forming layer containing a pigment can be transferred to an image receiving sheet by making use of the heat energy and an image can be formed on the image-forming sheet. Examples of the state include solid state, softened state, liquid state and gas state and although the pigment, dye or image forming layer may be changed into any of these states, from solid to softened state is preferred. The thermal transfer recording using laser light irradiation includes, for example, conventionally known fusion-type transfer, transfer using ablation, and sublimation-type transfer.

Among these, the above-described thin-film transfer type and the fusion/ablation type are preferred in that an image having hues analogous to printing is formed.

For performing the process of transferring the image receiving sheet having printed thereon an image to a printing paper sheet (hereinafter referred to as "real sheet") in a recording apparatus, a heat laminator is usually used. After the image forming sheet is superposed on a real sheet, heat and pressure are applied thereon to bond these sheets. Thereafter, the image receiving sheet is peeled off from the real sheet, as a result, only the image receiving layer containing an image remains on the real sheet.

By connecting this apparatus to a plate-making system, a system capable of exerting a color proofing function can be established. In this system, a printed matter having an image quality as close as to the printed matter output from the plate-making date must be output from the above-described recording apparatus. To satisfy this requirement, a software for approximating colors and dots to the printed matter is necessary. Specific examples of the connection is described below.

In the case of taking a proof of a printed matter from a plate-making system (for example, Celebra manufactured by Fuji Photo Film Co., Ltd.), the system connection is performed as follows. A CTP (Computer to Plate) system is connected to a plate-making system. The printing plate output by this is used for printing in a printing press, whereby a final printed matter is obtained. The above-described recording apparatus for color proofing is connected to a plate-making system and between these, PD System (registered trademark) for approximating colors and dots to the printed matter is connected as a proof drive software.

The contone (continuous tone) date are converted into raster data in the plate-making system, the raster data are converted into binary data for a halftone image, the binary data are output into a CTP system, and an image is finally printed. On the other hand, the same contone-data are output into the PD system and the PD system converts the received data based on a four-dimensional (black, cyan, magenta and yellow) table such that the colors agree with the printed matter. The data are finally converted into binary data for a halftone image such that the image agrees with the dots of the printed matter, and then output into the recording apparatus.

The four-dimensional table is previously prepared by performing an experiment and stored within the system. The experiment for preparing the four-dimensional table is performed as follows. Using important color data, an image printed via CTP system and an image output from a recording apparatus via PD system are prepared and the measured color values are compared. The table is prepared to minimize the difference therebetween.

The thermal transfer sheet of the present invention and the image receiving sheet, which are suitably used in the recording apparatus of the above-described system, are described below.

[Thermal Transfer Sheet]

The thermal transfer sheet comprises a support having thereon at least a light-to-heat conversion layer and an image forming layer in this order and if desired, also having other layers.

(Support)

The material for the support of the thermal transfer sheet is not particularly limited and various support materials may be used according to the end use. The support preferably has rigidity, good dimensional stability and durability against heat on the image formation. Preferred examples of the support material include synthetic resin materials such as polyethylene terephthalate, polyethylene-2,6-naphthalate, polycarbonate, polymethyl methacrylate, polyethylene, polypropylene, polyvinyl chloride, polyvinylidene chloride, polystyrene, styrene-acrylonitrile copolymer, polyamide (aromatic or aliphatic), polyimide, polyamidoimide and polysulfone. Among these, biaxially stretched polyethylene terephthalate is preferred in view of the mechanical strength and dimensional stability against heat. In the case of using the thermal transfer sheet for the manufacture of a color proof using laser recording, the support is preferably formed of a transparent synthetic resin material capable of transmitting laser light. The thickness of the support is preferably from 25 to 130 $\mu$m, more preferably from 50 to 120 $\mu$m. The center line average surface roughness Ra of the support in the image forming layer side is preferably less than 0.1 $\mu$m (measured according to JIS B0601 using a surface roughness meter (Surfcom 570A-3DF, manufactured by Tokyo Seimitsu Co., Ltd.)). The Young's modulus in the longitudinal direction of the support is preferably from 200 to 1,200 kg/mm$^2$ (about 20 to 12 GPa) and the Young's modulus in the cross direction is preferably from 250 to 1,600 kg/mm$^2$ (about 2.5 to 16 GPa). The F-5 value in the longitudinal direction of the support is preferably from 5 to 50 kg/mm$^2$ (about 49 to 490 MPa) and the F-5 value in the cross direction of the support is preferably from 3 to 30 kg/mm$^2$ (about 29.4 to 294 MPa). The F-5 value in the longitudinal direction of the support is generally higher than the F-5 value in the cross direction of the present invention but this does not apply when the strength particularly in the cross direction must be rendered high. The heat shrinkage rate at 100° C. for 30 minutes in the longitudinal and cross directions of the support is preferably 3% or less, more preferably 1.5% or less, and the heat shrinkage rate at 80° C. for 30 minutes is preferably 1% or less, more preferably 0.5% or less. The breaking strength is preferably from 5 to 100 kg/mm$^2$ (about 49 to 980 MPa) in both directions and the elastic modulus is preferably from 100 to 2,000 kg/mm$^2$ (about 0.49 to 19.6 GPa).

The support of the thermal transfer sheet may be subjected to a surface activation treatment and/or a treatment of providing one or more undercoat layer so as to improve the adhesive property to the light-to-heat conversion layer provided on the support. Examples of the surface activation treatment include a glow discharge treatment and a corona discharge treatment. The material for the undercoat layer preferably exhibits high adhesive property to the surface of both the support and the light-to-heat conversion layer and has small heat conductivity or excellent heat resistance. Examples of such a material for the undercoat layer include styrene, styrene-butadiene copolymer and gelatin. The thickness of the entire undercoat layer is usually from 0.01 to 2 $\mu$m. If desired, the surface opposite the side where the light-to-heat conversion layer of the heat-transfer sheet is provided may be subjected to a treatment of providing various functional layers such as reflection preventing layer and antistatic layer, or to a surface treatment.

(Back Layer)

The back layer of the thermal transfer sheet of the present invention is constructed by two layers, namely, a first back layer adjacent to the support and a second back layer provided on the first back layer in the side opposite the support. In the present invention, the ratio B/A of the weight A of the antistatic agent contained in the first back layer to the weight B of the antistatic agent contained in the second back layer is preferably less than 0.3. If the B/A is 0.3 or more, the slipping property and the powder-falling off from the back layer are worsened.

The layer thickness of the first back layer is preferably from 0.01 to 1 $\mu$m, more preferably from 0.01 to 0.2 $\mu$m. The layer thickness D of the second back layer is preferably from 0.01 to 1 $\mu$m, more preferably from 0.01 to 0.2 $\mu$m. The ratio C:D in the layer thickness between these first and second back layers is preferably from 1:2 to 5:1.

Examples of the antistatic agent which can be used in the first and second back layers include nonionic surfactants such as polyoxyethylene alkylamine and glycerol fatty acid ester, cationic surfactants such as quaternary ammonium salt, anionic surfactants such as alkyl phosphate, amphoteric surfactants, and compounds such as electrically conducting resin.

An electrically conducting fine particle can also be used as the antistatic agent. Examples of the electrically conducting fine particle include oxides such as ZnO, $TiO_2$, $SnO_2$, $Al_2O_3$, $IN_2O_3$, MgO, BaO, CoO, CuO, $Cu_2O$, CaO, SrO, $BaO_2$, PbO, $PbO_2$, $MnO_3$, $MoO_3$, $SiO_2$, $ZrO_2$, $Ag_2O$, $Y_2O_3$, $Bi_2O_3$, $Ti_2O_3$, $Sb_2O_3$, $Sb_2O_5$, $K_2Ti_6O_{13}$, $NaCaP_2O_{18}$ and $MgB_2O_5$; sulfides such as CuS and ZnS; carbides such as SiC, TiC, ZrC, VC, NbC, MoC and WC; nitrides such as $Si_3N_4$, TiN, ZrN, VN, NbN and $Cr_2N$; borides such as $TiB_2$, $ZrB_2$, $NbB_2$, $TaB_2$, CrB, MoB, WB and $LaB_5$; suicides such as $TiSi_2$, $ZrSi_2$, $NbSi_2$, $TaSi_2$, $CrSi_2$, $MoSi_2$ and $WSi_2$; metal salts such as $BaCO_3$, $CaCO_3$, $SrCO_3$, $BaSO_4$ and $CaSO_4$; and composite materials such as $SiN_4$—SiC and $9Al_2O_3$—$2B_2O_3$. These may be used individually or in combination of two or more thereof. Among these, $SnO_2$, ZnO, $Al_2O_3$, $TiO_2$, $In_2O_3$, MgO, BaO and $MoO_3$ are preferred, $SnO_2$, ZnO, $In_2O_3$ and $TiO_2$ are more preferred, and $SnO_2$ is still more preferred.

In the case of using the thermal transfer sheet of the present invention in the laser thermal transfer system, the antistatic agent used in the back layer preferably has substantial transparency so that the laser light can transmit therethrough.

In the case of using an electrically conducting metal oxide as the antistatic agent, the particle size thereof is preferably smaller so as to reduce the light scattering as much as possible, however, the particle size must be determined using the ratio in the refractive index between the particle and the binder as a parameter and can be obtained using the Mie Scattering Theory. The average particle size is generally from 0.001 to 0.5 $\mu$m, preferably from 0.003 to 0.2 $\mu$m. The average particle size as used herein is a value including not only a primary particle size of the electrically conducting metal oxide but also a particle size of (hkl) structures.

In addition to the antistatic agent, various additives such as surfactant, sliding agent and matting agent, or a binder may be added to the first and second back layers. The amount of the antistatic agent contained in the first back layer is preferably from 10 to 1,000 parts by weight, more preferably from 200 to 800 parts by weight, per 100 parts by weight of the binder. The amount of the antistatic agent contained in the second back layer is preferably from 0 to 300 parts by weight, more preferably from 0 to 100 parts by weight, per 100 parts by weight of the binder.

Examples of the binder which can be used in the formation of first and second back layers include homopolymers and copolymers of acrylic acid-based monomers such as acrylic acid, methacrylic acid, acrylic acid ester and methacrylic acid ester; cellulose-based polymers such as nitrocellulose, methyl cellulose, ethyl cellulose and cellulose acetate; vinyl-based polymers and copolymers of vinyl compounds, such as polyethylene, polypropylene, polystyrene, vinyl chloride copolymer, vinyl chloride-vinyl acetate copolymer, polyvinyl pyrrolidone, polyvinyl butyral and polyvinyl alcohol; condensed polymers such as polyester, polyurethane and polyamide; polymers resulting of polymerization or crosslinking of a photopolymerizable or thermopolymerizable compound such as epoxy compound; and melamine compounds.

(Light-to-Heat Conversion Layer)

The light-to-heat conversion layer contains a light-to-heat conversion substance, a binder and if desired, a matting agent. Furthermore, if desired, the light-to-heat conversion layer contains other components.

The light-to-heat conversion substance is a substance having a function of converting light energy on irradiation into heat energy. This substance is generally a dye (including a pigment, hereinafter the same) capable of absorbing laser light. In the case of performing the image recording using an infrared laser, an infrared absorbing dye is preferably used as the light-to-heat conversion substance. Example of the dye include black pigments such as carbon black; pigments formed of a macrocyclic compound having absorption in the region from visible to near infrared, such as phthalocyanine and naphthalocyanine; organic dyes used as a laser-absorbing material in the high-density laser recording of an optical disk or the like, such as cyanine dyes (e.g., indolenine dye), anthraquinone-based dyes, azulene-based dyes and phthalocyanine-based dyes; and organometallic compound dyes such as dithiol-nickel complex. Among these, cyanine-based dyes are preferred because this dye exhibits a high absorption coefficient to light in the infrared region and when used as a light-to-heat conversion substance, the thickness of the light-to-heat conversion layer can be reduced, as a result, the recording sensitivity of the thermal transfer sheet can be more improved.

Other than the dye, particulate metal materials such as blacked silver, and inorganic materials may also be used as the light-to-heat conversion substance.

In the present invention, the light-to-heat conversion substance is preferably water-insoluble because the light-to-heat conversion substance is uniformly dispersed in the light-to-heat conversion layer and hardly causes coagulation or crystallization in the light-to-heat conversion layer, and sharp absorption can be attained.

Also, from the standpoint of utilizing the high power infrared laser capable of manufacturing as a light source, the light-to-heat conversion substance in the light-to-heat conversion layer preferably has a maximum absorbance at a wavelength of 700 to 1,200 nm, more preferably from 750 to 1100 nm.

The binder contained in the light-to-heat conversion layer is preferably a resin having at least a strength sufficiently large to form a layer on a support and having a high heat conductivity. A resin having heat resistance and being incapable of decomposing even by the heat generated from the light-to-heat conversion substance on image recording is more preferred because even when light irradiation of higher energy is performed, the smoothness on the surface of the light-to-heat conversion layer can be maintained after the light irradiation. More specifically, a resin having a thermal decomposition temperature (a temperature of giving decrement of 5% by weight according to the TGA method (thermogravimetric analysis) in an air stream at a temperature-rising rate of 10° C./min) of 400° C. or more is preferred and a resin having the thermal decomposition temperature of 500° C. or more is more preferred. Also, the binder preferably has a glass transition temperature of 200 to 400° C., more preferably from 250 to 350° C. If the glass transition temperature is less than 200° C., fogging may be generated on the formed image, whereas if it exceeds 400° C., the solubility of the resin decreases and the production efficiency may be lowered.

The heat resistance (for example, thermal deformation temperature or thermal decomposition temperature) of the binder in the light-to-heat conversion layer is preferably high as compared with the materials used in other layers provided on the light-to-heat conversion layer.

Specific examples of the binder include acrylic acid-based resin such as methyl polymethacrylate; polycarbonate; polystyrenes; vinyl-based resins such as vinyl chloride/vinyl acetate copolymer and polyvinyl alcohol; polyvinyl butyral, polyester; polyvinyl chloride; polyamide; polyimide; polyether imide; polysulfone; polyether sulfone; aramid; polyurethane; epoxy resin; and urea/melamine resin.

In the present invention, for elevating the absorbance of the light-to-heat conversion layer and improve the sensitivity, a binder having a solubility parameter (SP value) obtained by the Hoy's method of 19.5 to 24.5 is preferably incorporated into the light-to-heat conversion layer of the thermal transfer sheet.

In the present invention, the SP value of the binder calculated according to the Hoy's method is as follows.

If the SP value of the binder is out of the range of from 19.5 to 24.5, the absorbance of the light-to-heat conversion layer becomes low and when a thermal transfer sheet and an image receiving sheet are superposed and after the laser recording, the image on the image receiving sheet is transferred on art paper or the like, a low image density results. With an SP value of the binder falling in the range of from 19.5 to 24.5, high absorbance and high transfer image density can be obtained. The SP value of the binder is preferably from 20 to 24, more preferably from 20 to 22.

Examples of the binder having an SP value obtained by the Hoy's method within the above-described range include cellulose diacetate, vinyl chloride/vinyl acetate copolymer, polyvinyl pyrrolidone, cellulose triacetate, phenol resin, novolak resin, polyester resin and vinyl chloride resin. Among these, cellulose diacetate, vinyl chloride/vinyl acetate copolymer and polyvinyl pyrrolidone are preferred. In the case where the resin is a copolymer, the SP value of the binder is affected by the chemical composition or the like and therefore, the resin is preferably selected by taking account of these points.

Examples of the matting agent contained in the light-to-heat conversion layers include inorganic fine particle and organic fine particle. Examples of the inorganic fine particle include metal salts such as silica, titanium oxide, aluminum oxide, zinc oxide, magnesium oxide, barium sulfate, magnesium sulfate, aluminum hydroxide, magnesium hydroxide and boron nitride, kaolin, clay, talc, zinc white, white lead, zieklite, quartz, kieselguhr, pearlite, bentonite, mica and synthetic mica. Examples of the organic fine particle include fluororesin particle, guanamine resin particle, acrylic resin particle, styrene-acryl copolymer resin particle, silicone resin particle, melamine resin particle and epoxy resin particle.

The particle size of the matting agent is usually from 0.3 to 30 $\mu$m, preferably from 0.5 to 20 $\mu$m, and the amount of the matting agent added is preferably 0.1 to 100 mg/m$^2$.

The light-to-heat conversion layer may contain, if desired, a surfactant, a thickener, an antistatic agent and the like.

(Polymer Mordant)

In the present invention, the light-to-heat conversion layer of the thermal transfer sheet preferably contains a polymer mordant. By virtue of the polymer mordant added, the light-to-heat conversion substance contained in the light-to-heat conversion layer, such as infrared absorbing dye, can be prevented from migrating into the image forming layer, so that the image can be prevented from deterioration such as fluctuation in the hue of recorded image resulting from coloration of the image forming layer due to the dye decomposed material or from discoloration of the dye decomposed material and also, the transferability can be prevented from changing for the worse at the time of re-transferring the image onto a final transfer material.

The polymer mordant is suitably a cationic polymer mordant or an anionic polymer mordant. Among the cationic polymer mordants, polymer modants having at least one structure of guanidium, iminium, ammonium, pyridinium and phosphonium are preferred. The polymer mordant may have only one of these structures or may have two or more thereof. A polymer mordant having an ammonium structure is more preferred.

Among the anionic polymer mordants, polymer mordants having a sulfonyl group or a carboxyl group are more preferred and a polymer mordant having a sulfonyl group is particularly preferred.

Of the above-described cationic polymer mordants, preferred examples of the polymer mordant having a guanidium structure include the compounds represented by the following formula (1):

(1)

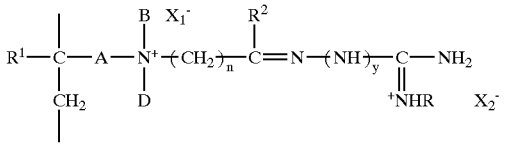

In formula (1), A is selected from the group consisting of a COO-alkylene group having from 1 to 5 carbon atoms, a CONH-alkylene group having from 1 to 5 carbon atoms, —COO—$(CH_2CH_2O)_n$—$CH_2$— and —CONH—$(CH_2CH_2O)_n$—$CH_2$— (wherein n is a number of 1 to 5).

B and D each is independently selected from the group consisting of an alkyl group having from 1 to 5 carbon atoms. Also, A, B, D and N are combined such that a heterocyclic compound selected from the group consisting of the following formula is formed.

Heterocyclic Rings

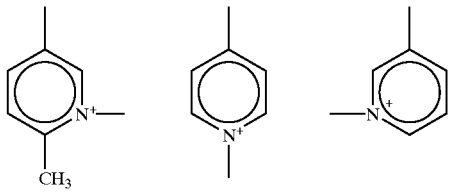

-continued

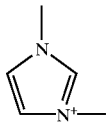

In formula (1), $R_1$ and $R_2$ each is independently selected from the group consisting of hydrogen, a phenyl group and an alkyl group having from 1 to 5 carbon atoms. R is selected from the group consisting of hydrogen atom, a phenyl group, a benzimidazolyl group and an alkyl group having from 1 to 5 carbon atoms. y is selected from the group consisting of 0 and 1. $X_1$ and $X_2$ each represents anion.

The polymer mordant represented by formula (1) is described in detail in Japanese published unexamined International application No. 8-508453.

Of the above-described cationic polymer mordants, preferred examples of the polymer mordant having an iminium structure include the compounds represented by the following formula (2):

(2)

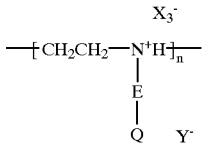

The polymer mordant represented by formula (2) comprises a polyethylene imine main chain having two or more pendant groups.

In formula (2), E represents an alkylene group. Q represents a group of the following formula:

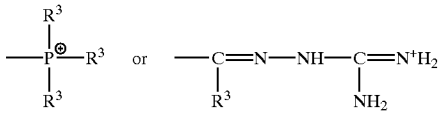

In formula (2), $R_3$ represents an alkyl group, an aryl group, an aralkyl group or an alkalyl group. n represents an integer of 2 or more. $X_3$ and Y each independently represents anion. The polymer mordant represented by formula (2) is described in detail in JP-A-7-304982.

Of the above-described cationic polymer mordants, preferred examples of the polymer mordant having a guanidium structure also include the compounds represented by the following formula (3):

(3)

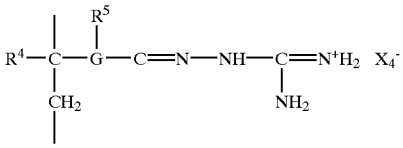

In formula (3), $R_4$ represents hydrogen or a methyl group. G represents —COO— or —COO-alkylene group, for example, —$COOCH_2$ or —$COOCH_2CH_2$. $R_5$ represents hydrogen or a lower alkyl group having from 1 to 4 carbon atoms. $X_4$ represents anion, for example, acetate, oxalate, sulfate, chloride or bromide.

The compound represented by formula (3) can contain a unit derived, for example, from acrylate, acrylamide, vinyl acetate, styrene, vinyl ether, vinyl ketone, vinyl alcohol, unsaturated chloride and nitrile, however, the amount of this copolymerizable unit is at most from 10 to 20% by weight.

The compound represented by formula (3) is described in detail in U.S. Pat. No. 4,695,531.

In the compounds represented by formula (3), the compound where the moiety G is excluded is disclosed in British Patent 850,281.

Of the above-described cationic polymer mordants, preferred examples of the polymer mordant having a pyridinium structure include the compounds represented by the following formula (4):

(4)

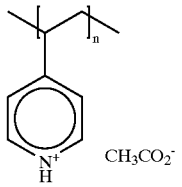

The compound represented by formula (4) is a cationic polymer mordant mainly comprising polyvinylpyridine and this compound is described in detail in U.S. Pat. No. 4,695,531.

Of the above-described cationic polymer mordants, preferred examples of the polymer mordant having an imidazolyl structure include the non-diffusive polymer mordants mainly comprising poly(N-vinylimidazole) described in JP-A-63-307979 and U.S. Pat. No. 4,500,631.

Furthermore, of the above-described cationic polymer mordants, preferred examples of the polymer mordant having an ammonium or guanidium structure include those disclosed in U.S. Pat. Nos. 2,945,006, 3,075,841, 3,271,148, 4,379,838 and 4,814,255.

Of the above-described cationic polymer mordants, preferred examples of the polymer mordant having a phosphonium structure include the polymer mordants having a pendant group represented by the following formula (5):

(5)

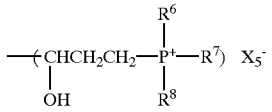

Suitable examples of the polymer mordant represented by formula (5) include the compounds represented by the following formula:

Polymer Mordant Having Pendant Group Represented by Formula (5):

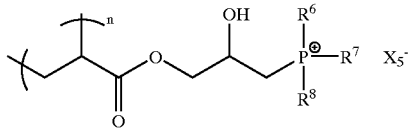

In formula (5) and the compounds shown above, $R_6$, $R_7$ and $R_8$ each represents an alkyl group, an aryl group or an aralkyl group, or arbitrarily selected two substituents represented by $R_6$ to $R_8$ form a part of a 5- or 6-membered heterocyclic ring. $X_5$ represents anion, usually anion of a mineral acid or carboxylic acid having from 2 to 20 carbon atoms.

The compound having a pendant group represented by formula (5) is described in detail in U.S. Pat. No. 3,429,839.

Of the above-described cationic polymer mordants, preferred examples of the polymer mordant having a phosphonium structure also include the compounds represented by the following formula (6):

(6)

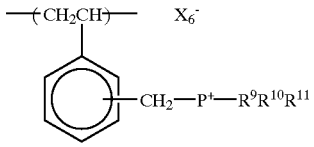

In formula (6), $R_9$, $R_{10}$ and $R_{11}$ each represents an alkyl group, an aryl group or an aralkyl group, or arbitrarily selected two substituents represented by $R_9$ to $R_{11}$ forms a part of a 5- or 6-membered heterocyclic ring. $X_6$ represents anion.

The compound represented by formula (5) is described in detail in U.S. Pat. No. 3,547,649.

Of the above-described cationic polymer mordants, other examples of the polymer mordant having a phosphonium structure are disclosed in U.S. Pat. Nos. 4,379,838, 4,855,211 and 4,820,608.

Specific examples of the compounds preferred as the polymer mordant contained in the light-to-heat conversion layer are set forth below, however, the polymer mordant for use in the present invention is not limited thereto.

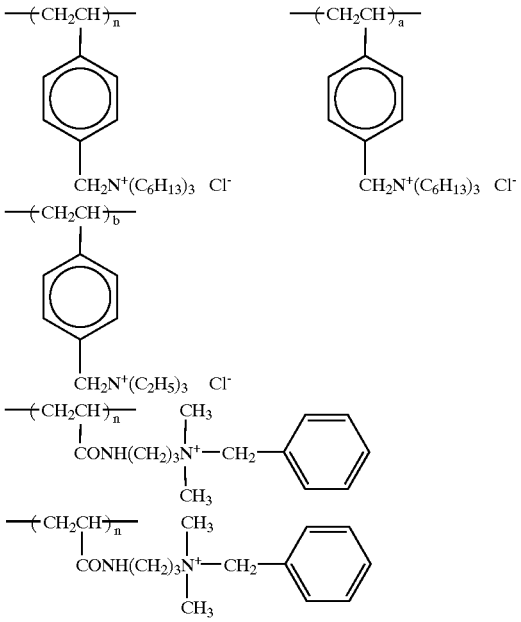

With respect to the amount of the polymer mordant contained in the light-to-heat conversion layer, the suitable range thereof varies depending on the kind of the light-to-heat conversion substance and the kind of the polymer mordant. However, the ratio (molar ratio) of the moiety undertaking an interaction with the polymer mordant in the light-to-heat conversion substance to the moiety undertaking an interaction with the light-to-heat conversion substance in the polymer mordant is preferably from 1:0.5 to 1:100, more preferably from 1:0.5 to 1:50.

The above-described polymer mordants which can be contained in the light-to-heat conversion layer may be used individually or in combination of two or more thereof.

The light-to-heat conversion layer can be provided by preparing a coating solution having dissolved therein a light-to-heat conversion substance and a binder and if desired, having added thereto a polymer mordant, a matting agent and other components, applying the coating solution onto a support and drying the solution. The drying is usually performed at a temperature of 300° C. or less, preferably at a temperature of 200° C. or less. In the case where polyethylene terephthalate is used as the support, the drying is preferably performed at a temperature of 80 to 150° C.

If the amount of the binder in the light-to-heat conversion layer is excessively small, the cohesion of the light-to-heat conversion layer decreases and at the time of transferring a formed image to an image receiving sheet, the light-to-heat conversion layer is readily transferred together and this causes color mixing of the image. The weight ratio of the solid contents between the light-to-heat conversion substance and the binder in the light-to-heat conversion layer is preferably from 1:20 to 2:1, more preferably from 1:10 to 2:1.

Also, as described above, reduction in the thickness of the light-to-heat conversion layer is preferred because the sensitivity of the thermal transfer sheet can be elevated. The thickness of the light-to-heat conversion layer is preferably from 0.03 to 1.0 $\mu$m, more preferably from 0.05 to 0.5 $\mu$m. Furthermore, the light-to-heat conversion layer preferably has an optical density of 0.80 to 1.26, more preferably from 0.92 to 1.15, for the light at a wavelength of 808 nm, whereby the image forming layer can be improved in the transfer sensitivity. If the optical density at a wavelength of 808 nm is less than 0.80, the irradiated light is insufficiently converted into heat and the transfer sensitivity lowers in some cases. On the other hand, if it exceeds 1.15, this affects the function of the light-to-heat conversion layer on recording and fogging may be generated.

(Image Forming Layer)

The image forming layer contains at least a pigment which is transferred to an image receiving sheet and forms an image, and further contains a binder for forming a layer and if desired, other components.

The pigment in general is roughly classified into an organic pigment and an inorganic pigment. These are appropriately selected according to the use end by taking account of their properties, that is, the former provides a coated film having high transparency and the latter generally exhibits excellent masking property. In the case where the thermal transfer sheet is used for a color proof in the printing, an organic pigment having a color agreeing with or close in color tone to the color of yellow, magenta, cyan or black printing ink employed in general is used. Other than these, a metal powder, a fluorescent pigment or the like is used in some cases. Examples of the pigment which is preferably used include azo-type pigments, phthalocyanine-type pigments, anthraquinone-type pigments, dioxazine-type pigments, quinacridone-type pigments, isoindolinone-type pigments and nitro-type pigments. The pigments for use in the image forming layers, classified by the hue, are described below.

1) Yellow Pigment

Pigment Yellow 12 (C.I. No. 21090):

Permanent Yellow DHG (produced by Clariant Japan), Lionol Yellow 1212B (produced by Toyo Ink), Irgalite Yellow LCT (produced by Ciba Specialty Chemicals), Symuler Fast yellow GTF 219 (produced by Dainippon Ink & Chemicals Inc.)

Pigment Yellow 13 (C.I. No. 21100):

Permanent Yellow GR (produced by Clariant Japan), Lionol Yellow 1313 (produced by Toyo Ink)

Pigment Yellow 14 (C.I. No. 21095):

Permanent Yellow G (produced by Clariant Japan), Lionol Yellow 1401-G (produced by Toyo Ink), Seika Fast Yellow 2270 (produced by Dainichi Seika Kogyo), Symuler Fast Yellow 4400 (produced by Dainippon Ink & Chemicals Inc.)

Pigment Yellow 17 (C.I. No. 21105):

Permanent Yellow GG02 (produced by Clariant Japan), Symuler Fast Yellow 8GF (produced by Dainippon Ink & Chemicals Inc.)

Pigment Yellow 155 (C.I. No. 21100):

Graphtol Yellow 3GP (produced by Clariant Japan)

Pigment Yellow 180 (C.I. No. 21290):

Novoperm Yellow P-HG (produced by Clariant Japan, PV Fast Yellow HG (produced by Clariant Japan)

Pigment Yellow 139 (C.I. No. 56298):

Novoperm Yellow M2R 70 (produced by Clariant Japan)

2) Magenta Pigment

Pigment Red 57:1 (C.I. No. 15850:1):

Graphtol Rubine L6B (produced by Clariant Japan), Lionol Red 6B-4290G (produced by Toyo Ink), Irgalite Rubine 4BL (produced by Ciba Specialty Chemicals), Symuler Brilliant Carmine 6B-229 (produced by Dainippon Ink & Chemicals Inc.)

Pigment Red 122 (C.I. No. 73915):

Hosterperm Pink E (produced by Clariant Japan), Lionogen Magenta 5790 (produced by Toyo Ink), Fastogen Super Magenta RH (produced by Dainippon Ink & Chemicals Inc.)

Pigment Red 53:1 (C.I. No. 15585:1):

Permanent Lake Red LCY (produced by Clariant Japan), Symuler Lake Red C conc (produced by Dainippon Ink & Chemicals Inc.)

Pigment Red 48:1 (C.I. No. 15865:1):

Lionol Red 2B 3300 (produced by Toyo Ink), Symuler Red NRY (produced by Dainippon Ink & Chemicals Inc.)

Pigment Red 48:2 (C.I. No. 15865:2):

Permanent Red W2T (produced by Clariant Japan), Lionol Red LX235 (produced by Toyo Ink), Symuler Red 3012 (produced by Dainippon Ink & Chemicals Inc.)

Pigment Red 48:3 (C.I. No. 15865:3):

Permanent Red 3RL (produced by Clariant Japan), Symuler Red 2BS (produced by Dainippon Ink & Chemicals Inc.)

Pigment Red 177 (C.I. No. 65300):

Cromophtal Red A2B (produced by Ciba Specialty Chemicals)

3) Cyan Pigment:

Pigment Blue 15 (C.I. No. 74160):

Lionol Blue 7027 (produced by Toyo Ink), Fastogen Blue BB (produced by Dainippon Ink & Chemicals Inc.)

Pigment Blue 15:1 (C.I. No. 74160):

Hosterperm Blue A2R (produced by Clariant Japan), Fastgen Blue 5050 (produced by Dainippon Ink & Chemicals Inc.)

Pigment Blue 15:2 (C.I. No. 74160):

Hosterperm Blue AFL (produced by Clariant Japan), Irgalite Blue BSP (produced by Ciba Specialty Chemicals), Fastgen Blue GP (produced by Dainippon Ink & Chemicals Inc.)

Pigment Blue 15:3 (C.I. No. 74160):

Hosterperm Blue B2G (produced by Clariant Japan), Lionol Blue FG7330 (produced by Toyo Ink), Cromophtal Blue 4GNP (produced by Ciba Specialty Chemicals), Fastgen Blue FGF (produced by Dainippon Ink & Chemicals Inc.)

Pigment Blue 15:4 (C.I. No. 74160):

Hosterperm Blue BFL (produced by Clariant Japan), Cyanine Blue 700-1° F.G (produced by Toyo Ink), Irgalite Blue GLNF (produced by Ciba Specialty Chemicals), Fastgen Blue FGS (produced by Dainippon Ink & Chemicals Inc.)

Pigment Blue 15:6 (C.I. No. 74160):

Lionol Blue ES (produced by Toyo Ink)

Pigment Blue 60 (C.I. No. 69800):

Hosterperm Blue RL01 (produced by Clariant Japan), Lionogen Blue 6501 (produced by Toyo Ink)

4) Black Pigment

Pigment Black 7 (Carbon Black C.I. No. 77266):

Mitsubishi Carbon Black MA100 (produced by Mitsubishi Chemical), Mitsubishi Carbon Black #5 (produced by Mitsubishi Chemical), Black Pearls 430 (produced by Cabot Co.)

The average particle size of the pigment is preferably from 0.03 to 1 $\mu$m, more preferably from 0.05 to 0.5 $\mu$m.

If the particle size is less than 0.03 $\mu$m, the dispersion may cost highly or the dispersion solution may be gelled, whereas if it exceeds 1 $\mu$m, coarse pigment particles may hinder the adhesion between the image forming layer and the image receiving layer or may hinder the transparency of the image forming layer.

The binder for the image forming layer is preferably an amorphous organic high molecular polymer having a softening point of 40 to 150° C. Examples of the amorphous organic high molecular polymer include homopolymers and copolymers of styrene, a derivative thereof or a substitution product thereof, such as butyral resin, polyamide resin, polyethylene imine resin, sulfonamide resin, polyester polyol resin, petroleum resin, styrene, vinyl toluene, α-methylstyrene, 2-methylstyrene, chloro-styrene, vinylbenzoic acid, sodium vinylbenzenesulfonate; and homopolymers and copolymers with another monomer of a vinyl monomer, for example, a methacrylic acid ester such as methyl methacrylate, ethyl methacrylate, butyl methacrylate or hydroxyethyl methacrylate, a methacrylic acid, an acrylic acid ester such as methyl acrylate, ethyl acrylate, butyl acrylate or α-ethylhexyl acrylate, an acrylic acid, a diene such as butadiene or isoprene, an acrylonitrile, a vinyl ether, a maleic acid, a maleic acid ester, a maleic anhydride, a cinnamic acid, a vinyl chloride, or a vinyl acetate. These resins may be used in a combination of two or more thereof.

The image forming layer preferably contains the pigment in an amount of 20 to 80% by weight, more preferably from 30 to 70% by weight, still more preferably from 30 to 50% by weight. Also, the image forming layer preferably contains the amorphous organic high molecular polymer in an amount of 80 to 20% by weight, more preferably from 70 to 30% by weight, still more preferably from 70 to 40% by weight.

The image forming layer may contain the following components (1) to (3) as other components.

(1) Waxes

The waxes include mineral waxes, natural waxes and synthetic waxes. Examples of the mineral waxes include petroleum waxes such as paraffin wax, microcrystalline wax, ester wax and oxidized wax; montan wax; ozokerite; and ceresine. Among these, paraffin wax is preferred. The paraffin wax is separated from petroleum and various products different in the melting point are available on the market.

Examples of the natural waxes include plant waxes such as carnauba wax, Japan wax, ouricury was and espal wax, and animal waxes such as beeswax, insect wax, shellac wax and spermaceti wax.

The synthetic wax is generally used as a lubricant and usually comprises a higher fatty acid compound. Examples of the synthetic waxes include the followings.

1) Fatty Acid Wax

Straight chain saturated fatty acids represented by the following formula:

$$CH_3\ (CH_2)_nCOOH$$

wherein n represents an integer of 6 to 28. Specific examples thereof include a stearic acid, a behenic acid, a palmitic acid, a 12-hydroxystearic acid and an azelaic acid.

In addition, metal salts (e.g., K. Ca, Zn, Mg) of the above-describe fatty acids may be used.

2) Fatty Acid Ester Wax

Specific examples of the ester of the above-described fatty acids include an ethyl stearate, a lauryl stearate, an ethyl behenate, a hexyl behenate and a behenyl mirystate 3) Fatty Acid Amide Wax Specific examples of the amide of the above-described fatty acids include a stearic acid amide and a lauric acid amide.

4) Aliphatic Alcohol Wax

Straight chain saturated aliphatic alcohols represented by the following formula:

$$CH_3\ (CH_2)_nOH$$

wherein n represents an integer of 6 to 28. Specific examples thereof include a stearyl alcohol.

Among these synthetic waxes 1) to 4), higher fatty acid amides such as stearic acid amide and lauric acid amide are preferred. The above-described wax compounds may be used, if desired, individually or in appropriate combination.

(2) Plasticizer

The plasticizer is preferably an ester compound and examples thereof include phthalic acid esters such as dibutyl phthalate, di-n-octyl phthalate, di(2-ethylhexyl) phthalate, dinonyl phthalate, dilauryl phthalate, butyllauryl phthalate and butylbenzyl phthalate; aliphatic dibasic acid esters such as di(2-ethylhexyl) adipate and di(2-ethylhexyl) sebacate; phosphoric acid triesters such as tricresyl phosphate and tri(2-ethylhexyl) phosphate; polyol polyesters such as polyethylene glycol ester; and epoxy compounds such as epoxy fatty acid ester. These plasticizers are well-known. Among these, esters of vinyl monomer, particularly esters of acrylic acid or methacrylic acid, are preferred in view of improvement in the transfer sensitivity or transfer unevenness and the control effect of elongation to break.

Examples of the ester compound of acrylic acid or methacrylic acid include polyethylene glycol dimethacrylate, 1,2,4-butanetriol trimethacrylate, trimethylolethane triacetate, pentaerythritol triacrylate, pentaerythritol tetraacrylate and dipentaerythritol polyacrylate.

The plasticizer may also be a polymer. In particular, polyester is preferred because of its great addition effect or difficult diffusibility under storage conditions. Examples of the polyester include sebacic acid-based polyester and adipic acid-based polyester.

These additives contained in the image forming layer are not limited thereto and the plasticizers may be used individually or in combination of two or more thereof.

If the content of the above-described additives in the image forming layer is excessively large, the resolution of the transfer image may lower, the film strength of the image forming layer itself may decreases or due to reduction in the adhesion between the light-to-heat conversion layer and the image forming layer, an unexposed area may be transferred to the image receiving layer. In view of these point, the wax content is preferably from 0.1 to 30% by weight, more preferably from 1 to 20% by weight, based on the total solid content in the image forming layer. The plasticizer content is preferably from 0.1 to 20% by weight, more preferably from 0.1 to 10% by weight, based on the total solid content in the image forming layer.

(3) Others

In addition to the above-described components, the image forming layer may contain a surfactant, an inorganic or organic fine particle (e.g., metal powder, silica gel), an oil (e.g., linseed oil, mineral oil), a thickener, an antistatic agent and the like. Except for the case of obtaining a black image, when a substance capable of absorbing light at the wavelength of the light source used in the image recording is incorporated, the energy necessary for the transfer can be reduced. The substance capable of absorbing light at the wavelength of the light source may be either a pigment or a dye, however, in the case of obtaining a color image, use of an infrared light source such as semiconductor laser for the image recording and use of a dye having small absorption in the visible region but large absorption at the wavelength of the light source are preferred in view of the color reproduction. Examples of the near infrared dye include the compounds described in JP-A-3-103476.

The image forming layer can be provided by preparing a coating solution having dissolved or dispersed therein the pigment, the binder and the like, applying the coating solution onto a light-to-heat conversion layer (when a heat-sensitive releasing layer (i.e., a heat-sensitive peeling layer) is provided on the light-to-heat conversion layer, on the heat-sensitive releasing layer), and drying the solution. Examples of the solvent used in the preparation of the coating solution include n-propyl alcohol, methyl ethyl ketone, propylene glycol monomethyl ether (MFG), methanol and water. The coating and the drying can be performed using ordinary coating and drying methods.

The thickness of the image forming layer is preferably from 0.2 to 1.5 $\mu$m, more preferably from 0.3 to 1.0 $\mu$m.

In the thermal transfer sheet of the present invention, an image forming layer may be provided directly on the light-to-heat conversion layer or an interlayer may be provided between the light-to-heat conversion layer and the image forming layer.

The interlayer provided may be a heat-sensitive releasing layer containing a heat-sensitive material which generates a gas or releases adhered water or the like under the action of heat generated from the light-to-heat conversion layer and thereby weakens the bonding strength between the light-to-heat conversion layer and the image forming layer. For the heat-sensitive material, a compound (a polymer or a low molecular compound) capable of decomposing or altering by itself due to heat and generating a gas, a compound (a polymer or a low molecular compound) having absorbed or adsorbed therein a fairly large amount of an easily vaporizable gas such as moisture, or the like may be used. These may be used in combination.

Examples of the polymer capable of decomposing or altering due to heat and generating a gas include self-oxidizing polymers such as nitrocellulose; halogen-containing polymers such as chlorinated polyolefin, chlorinated rubber, polychlorinated rubber, polyvinyl chloride and polyvinylidene chloride; acrylic polymers such as polyisobutyl methacrylate having adsorbed therein a volatile compound such as moisture; cellulose esters such as ethyl cellulose having adsorbed therein a volatile compound such as moisture; and naturally occurring polymer compounds such as gelatin having adsorbed therein a volatile compound such as moisture. Examples of the low molecular compound capable of decomposing or altering due to heat and generating a gas include compounds which undergo an exothermic decomposition and thereby generate a gas, such as diazo compound and azide compound.

The temperature at which the heat-sensitive material decomposes or alterations due to heat is preferably 280° C. or less, more preferably 230° C. or less.

In the case where a low molecular compound is used as the heat-sensitive material of the heat-sensitive releasing layer, the compound is preferably combined with a binder. The binder used here may be the above-described polymer capable of decomposing or altering by itself due to heat and generating a gas, or may be an ordinary binder lacking in this property. When the heat-sensitive low molecular compound is used in combination with a binder, the weight ratio of the former to the latter is preferably from 0.02:1 to 3:1, more preferably from 0.05:1 to 2:1. The heat-sensitive releasing layer preferably covers almost the entire surface of the light-to-heat conversion layer. The thickness of the heat-sensitive releasing layer is generally from 0.03 to 1 $\mu$m, preferably from 0.05 to 0.5 $\mu$m.

In the case of a thermal transfer sheet constructed such that a light-to-heat conversion layer, a heat-sensitive releasing layer and an image forming layer are stacked in this order on a support, the heat-sensitive releasing layer undergoes decomposition or altaration due to heat transmitted from the light-to-heat conversion layer and generates a gas. By this decomposition or gas generation, the heat-sensitive releasing layer is partially lost or a cohesive failure takes place within the heat-sensitive releasing layer, as a result, the bonding strength between the light-to-heat conversion layer and the image forming layer diminishes. Accordingly, depending on the behavior of the heat-sensitive releasing layer, a part of the heat-sensitive releasing layer may adhere to the image forming layer and appear on the finally formed image, giving rise to color mixing of the image. Because of this, in order to ensure that color mixing is not visually discernible in the formed image even if the above-described transfer of the heat-sensitive releasing layer takes place, the heat-sensitive releasing layer is preferably almost colorless, that is, highly transmissive to visible light. Specifically, the light absorption coefficient of the heat-sensitive releasing layer is, for visible light, 50% or less, preferably 10% or less.

The thermal transfer sheet of the present invention may also be constructed such that instead of independently forming the heat-sensitive releasing layer, the above-described heat-sensitive material is added to the coating solution for the light-to-heat conversion layer and the formed the light-to-heat conversion layer serves as a light-to-heat conversion layer and as a heat-sensitive releasing layer at the same time.

In the present invention, for performing the image transfer with good sensitivity and no film fogging, the binder in each layer is selected such that the absolute value of the difference in the SP value obtained by the Okitsu's method between the binder contained in the image forming layer and the organic high molecular polymer contained in the underlying layer thereof is 1.5 or more. By selecting the binder as such, the adhesive strength between the image forming layer and the underlying layer thereof can be diminished and the image forming layer can be smoothly separated from the underlying layer thereof at the transfer. The SP value of the binder is calculated by the Okitsu's method.

The outermost layer of the thermal transfer sheet in the side where the image forming layer is provided preferably has a static friction coefficient of 0.35 or less, more preferably 0.20 or less. When the outermost layer is rendered to have a static friction coefficient of 0.35 or less, the roll staining can be prevented from occurring at the time of transporting the thermal transfer sheet and the formed image can have high quality. The coefficient of static friction is measured according to the method described in JP-A-2001-47753, paragraph [0011].

The Smooster value on the surface of the image forming layer is preferably from 0.5 to 50 mmHg (about 0.0665 to 6.65 kPa) at 23° C. and 55% RH and at the same time, the Ra value is preferably from 0.05 to 0.4 μm. With these values, a large number of microscopic voids formed on the contact surface to inhibit the contacting between the image receiving layer and the image forming layer can be reduced and this is advantageous in view of the transfer and in turn the image quality. The Ra value can be measured according to JIS B0601 using a surface roughness meter (Surfcom, manufactured by Tokyo Seimitsu Co., Ltd.). The surface hardness of the image forming layer is preferably 10 g or more with a sapphire needle. One second after the earth connection of the thermal transfer sheet which is electrified according to Federal Test Standard 4046, the charge potential of the image forming layer is preferably from −100 to 100 V. The surface resistance of the image forming layer is preferably $10^9$ Ω or less at 23° C. and 55% RH.

The image receiving sheet which can be used in combination with the above-described thermal transfer sheet is described below.

[Image Receiving Sheet]

(Layer Construction)

The image receiving sheet usually has a construction such that one or more image receiving layer is provided on a support and if desired, any one or more of a cushion layer, a releasing layer (i.e., a peeling layer) and an interlayer is provided between the support and the image receiving layer. In view of the transportation, the image receiving sheet preferably has a back layer on the surface of the support in the side opposite the image receiving layer.

(Support)

Examples of the support include normal sheet-like substrates such as plastic sheet, metal sheet, glass sheet, resin coated paper, paper and various composite bodies. Examples of the plastic sheet include polyethylene terephthalate sheet, polycarbonate sheet, polyethylene sheet, polyvinyl chloride sheet, polyvinylidene chloride sheet, polystyrene sheet and styrene-acrylonitrile copolymer sheet. Examples of the paper include printing paper and coated paper.

The support preferably has fine voids because the image quality can be improved, and this support can be manufactured as follows. For example, a thermoplastic resin and a filler comprising an inorganic pigment or a polymer incompatible with the thermoplastic resin are mixed, the obtained mixture melt is formed into a single-layer or multi-layer film using a melt extruder and the film is uniaxially or biaxially stretched. In this case, the void percentage is determined by the resin and filler selected, the mixing ratio, the stretching conditions and the like.

The above-described thermoplastic resin is preferably a polyolefin resin such as polypropylene, or a polyethylene terephthalate resin because of their high crystallinity, good stretching property and easiness in the formation of voids. It is preferred to use the polyolefin resin or polyethylene terephthalate resin as the main component and appropriately use a small amount of another thermoplastic resin in combination. The inorganic pigment used as the filler preferably has an average particle size of 1 to 20 μm and examples of the inorganic pigment which can be used include calcium carbonate, clay, kieselguhr, titanium oxide, aluminum hydroxide and silica. In the case of using polypropylene as the thermoplastic resin, polyethylene terephthalate is preferably used in combination for the filler as the incompatible resin of the filler. The support having fine voids is described in detail in JP-A-2001-105752.

In the support, the content of the filler such as inorganic pigment is generally on the order of 2 to 30% by volume.

In the image receiving sheet, the thickness of the support is usually from 10 to 400 μm, preferably from 25 to 200 μm. The surface of the support may be subjected to a surface treatment such as corona discharge treatment or glow discharge treatment so as to elevate the adhesive property with the image receiving layer (or cushion layer) or to elevate the adhesive property with the image forming layer of the thermal transfer sheet.

(Image Receiving Layer)

Since the image forming layer is transferred and fixed on the surface of the image receiving layer, one or more image receiving layer is preferably provided on the support. The image receiving layer is preferably formed mainly of an organic polymer binder. This binder is preferably a thermoplastic resin and examples thereof include homopolymers and copolymers of acrylic acid-based monomers, such as acrylic acid, methacrylic acid, acrylic acid ester and methacrylic acid ester; cellulose-based polymers such as methyl cellulose, ethyl cellulose and cellulose acetate; homopolymers and copolymers of vinyl-based monomers, such as polystyrene, polyvinyl pyrrolidone, polyvinyl butyral, polyvinyl alcohol and polyvinyl chloride; condensed polymers such as polyester and polyamide; and rubber-based polymers such as butadiene-styrene copolymer. For obtaining an appropriate adhesive strength with the image forming layer, the binder of the image forming layer is preferably a polymer having a glass transition temperature (Tg) of less than 90° C. For this purpose, it is also possible to add a plasticizer to the image forming layer. Furthermore, the binder polymer preferably has a Tg of 30° C. or more so as to prevent blocking between sheets. In particular, from the standpoint of improving the adhesive property with the image forming layer at the time of laser recording and elevating the sensitivity or image strength, the polymer is preferably the same as or analogous to the binder polymer of the image forming layer.

The Smooster value on the surface of the image receiving layer is preferably from 0.5 to 50 mmHg (about 0.0665 to 6.65 kPa) at 23° C. and 55% RH and at the same time, the Ra value is preferably from 0.05 to 0.4 μm. With these values, a large number of microscopic voids formed on the contact surface to inhibit the contacting between the image receiving layer and the image forming layer can be reduced and this is advantageous in view of the transfer and in turn the image quality. The Ra value can be measured according to JIS B0601 using a surface roughness meter (Surfcom, manufactured by Tokyo Seimitsu Co., Ltd.). One second after the earth connection of the image receiving sheet which is electrified according to Federal Test Standard 4046, the charge potential of the image receiving layer is preferably from −100 to 100 V. The surface resistance of the image receiving layer is preferably $10^9$ Ω or less at 23° C. and 55% RH. The coefficient of static friction is preferably 0.2 or less on the surface of the image receiving layer and the surface energy on the surface of the image receiving layer is preferably from 23 to 35 mg/m$^2$.

In the case of once forming an image on the image receiving layer and re-transferring the image to printing paper or the like, at least one layer of the image receiving layer is preferably formed of a photocurable material. Examples of the composition for the photocurable material include a combination of a) a photopolymerizable monomer comprising at least one polyfunctional vinyl or vinylidene compound capable of forming a photopolymer through addition polymerization, b) an organic polymer, c) a photopolymerization initiator and if desired, additives such as thermopolymerization inhibitor. For the polyfunctional vinyl monomer, an unsaturated ester of polyol, particularly an ester of acrylic acid or methacrylic acid, such as ethylene glycol diacrylate, pentaerythritol tetraacrylate, is used.

Examples of the organic polymer include polymers described above as the polymer for the formation of the image receiving layer. As for the photopolymerization inhibitor, a normal photoradical polymerization initiator such as benzophenone or Michler's ketone is used in a proportion of 0.1 to 20% by weight of the layer.

The thickness of the image receiving layer is from 0.3 to 7 μm, preferably from 0.7 to 4 μm. If the thickness is less than 0.3 μm, the film strength is not sufficiently high and the layer is readily ruptured upon re-transfer to printing paper, whereas if the thickness is excessively large, the gloss of image transferred to the printing paper increases and the approximation to a printed matter decreases.

(Other Layers)

A cushion layer may be provided between the support and the image receiving layer. When a cushion layer is provided, the adhesive property between the image forming layer and the image receiving layer is improved at the thermal transfer using a laser and the image quality can be improved. Furthermore, even if foreign matters are mingled between the thermal transfer sheet and the image receiving sheet at the recording, voids between the image receiving layer and the image forming layer are reduced by the deformation action of the cushion layer, as a result, the size of image defects such as clear spot can be made small. In addition, when an image is formed by transfer and this image is transferred to separately prepared printing paper or the like, the image surface is deformed according to roughness on the paper surface and therefore, the transferability of the image receiving layer can also be improved or by reducing the gloss of the transferee material, the approximation to a printed matter can be improved.

The cushion layer has a structure easy to deform upon application of a stress onto the image forming layer and for achieving the above-described effect, this layer is preferably formed of a material having a low modulus of elasticity, a material having rubber elasticity or a thermoplastic resin which is easily softened under heating. The elastic modulus of the cushion layer is preferably from 0.5 MPa to 1.0 GPa, more preferably from 1 MPa to 0.5 GPa, still more preferably from 10 to 100 MPa, at room temperature. Also, for burying foreign matters such as dust, the penetration (25° C., 100 g, 5 seconds) prescribed by JIS K2530 is preferably 10 or more. The glass transition temperature of the cushion layer is 80° C. or less, preferably 25° C. or less, and the softening point is preferably from 50 to 200° C. For adjusting these physical properties, for example, Tg, it is suitable to add a plasticizer into the binder.

Specific examples of the material used as the binder of the cushion layer include polyethylene, polypropylene, polyester, styrene-butadiene copolymer, ethylene-vinyl acetate copolymer, ethylene-acryl copolymer, vinyl chloride-vinyl acetate copolymer, vinylidene resin, plasticizer-containing vinyl chloride resin, polyamide resin, phenol resin and rubbers such as urethane rubber, butadiene rubber, nitrile rubber, acryl rubber and natural rubber.

The thickness of the cushion layer is varied depending on the resin used and other conditions but is usually from 3 to 100 μm, preferably from 10 to 52 μm.

The image receiving layer and the cushion layer must be bonded until the laser recording stage but for transferring the image to printing paper, these layers are preferably provided in the releasable state. In order to facilitate the release, a releasing layer having a thickness of approximately from 0.1 to 2 μm is preferably provided between the cushion layer and the image receiving layer. If the film thickness is excessively large, the capability of the cushion layer cannot be easily brought out. The film thickness must be adjusted depending on the kind of the releasing layer.

Specific examples of the binder of the releasing layer include polyolefin, polyester, polyvinyl acetal, polyvinyl formal, polyparabanic acid, polymethyl methacrylate, polycarbonate, ethyl cellulose, nitrocellulose, methyl cellulose, carboxymethyl cellulose, hydroxypropyl cellulose, polyvinyl alcohol, polyvinyl chloride, urethane resin, fluorine-containing resin, styrenes such as polystyrene and acrylonitrile styrene, crosslinked products of these resins, and thermosetting resins having a Tg of 65° C. or more and cured products of these resins, such as polyamide, polyimide, polyether imide, polysulfone, polyether sulfone and aramid. The curing agent used here can be a general curing agent such as isocyanate and melamine.

On considering the above-described properties in the selection of the binder of the releasing layer, polycarbonate, acetal and ethyl cellulose are preferred in view of their storability. Combining with this, an acrylic resin is preferably used in the image-forming layer, because good releasability (i.e., good peeling property) can be provided at the time of re-transferring the image thermally transferred using a laser.

Also, another layer which is extremely reduced in the adhesive property with the image forming layer on cooling may be used as the releasing layer. Specifically, a layer mainly comprising a heat-fusible compound such as wax or binder, or a thermoplastic resin may be provided.

Examples of the heat-fusible compound include the substances described in JP-A-63-193886. In particular, microcrystalline wax, paraffin wax and carnauba wax are preferred. As for the thermoplastic resin, preferred examples thereof include ethylene-based copolymers (e.g., ethylene-vinyl acetate resin) and cellulose-based resins.

In these releasing layers, a higher fatty acid, a higher alcohol, a higher fatty acid ester, an amide, a higher amine or the like may be added as an additive, if desired.

In another construction of the releasing layer, the layer is fused or softened on heating and undertakes cohesive failure by itself, thereby exhibiting releasability (i.e., peeling property). This releasing layer preferably contains a supercooling substance.

Examples of the supercooling substance include poly-ε-caprolactone, polyoxyethylene, benzotriazole, tribenzylamine and vanillin.

In still another construction of the releasing layer, a compound capable of reducing the adhesive property with the image forming layer is incorporated. Examples of this compound include silicone-based resins such as silicone oil; fluorine-containing resins such as fluorine-containing acrylic resin; polysiloxane resin; acetal-based resins such as polyvinyl butyral, polyvinyl acetal and polyvinyl formal; solid waxes such as polyethylene wax and amide wax; and fluorine-containing or phosphoric acid-based surfactants.

The releasing layer can be formed by a method where the above-described raw materials are dissolved or dispersed like a latex in a solvent and the solution or dispersion is coated on the cushion layer using a coating method such as blade coater, roll coater, bar coater, curtain coater or gravure coater, or an extrusion lamination method by hot melting. The releasing layer can also be formed by a method where the raw materials dissolved or dispersed like a latex in a solvent is coated on a temporary base using the above-described method, the coating is attached to the cushion layer, and the temporary base is peeled off.

The image receiving sheet combined with the thermal transfer sheet may have a structure such that the image receiving layer serves also as the cushion layer. In this case, the image receiving sheet may have a structure of support/cushiony image receiving layer or support/undercoat layer/cushiony image receiving layer. Also in this case, the cushiony image receiving layer is preferably provided in the releasable state so that the re-transfer to the printing paper can be facilitated. If the case is so, the image after the re-transfer to the printing paper is an image having excellent glossiness.

The thickness of the cushiony image receiving layer is from 5 to 100 $\mu$m, preferably from 10 to 40 $\mu$m.

In the image receiving sheet, a back layer is preferably provided on the surface of the support in the side opposite the surface where the image receiving layer is provided, because the image receiving sheet can exhibit good transportation property. For the purpose of attaining good transportation within the recording apparatus, the back layer preferably contains an antistatic agent using a surfactant or tin oxide fine particle, and a matting agent using silicon oxide or PMMA particle.

These additives can be added not only to the back layer but also, if desired, to the image receiving layer or other layers. For example, in the case of a matting agent, particles having an average particle size of 0.5 to 10 $\mu$m may be added to the layer in a proportion of approximately from 0.5 to 80%. The antistatic agent may be appropriately selected from various surfactants and electrically conducting agents and used such that the surface resistance of the layer is $10^{12}$ $\Omega$ or less, preferably $10^{9}$ $\Omega$ or less, under the conditions of 23° C. and 50% RH.

For the binder used in the backcoat layer, a general-purpose polymer may be used, such as gelatin, polyvinyl alcohol, methyl cellulose, nitrocellulose, acetyl cellulose, aromatic polyamide resin, silicone resin, epoxy resin, alkyd resin, phenol resin, melamine resin, fluororesin, polyimide resin, urethane resin, acrylic resin, urethane-modified silicone resin, polyethylene resin, polypropylene resin, polyester resin, Teflon resin, polyvinyl butyral resin, vinyl chloride-based resin, polyvinyl acetate, polycarbonate, organic boron compounds, aromatic esters, fluorinated polyurethane and polyether sulfone.

When a crosslinkable water-soluble binder is used as the binder of the backcoat layer, this is effective in preventing the matting agent from powder-falling or improving the scratch resistance of the backcoat. This use is also greatly effective on the blocking during storage.

As for the crosslinking means, heat, active ray and pressure may be used individually or in combination without any particular limitation according to the properties of the crosslinking agent used. Depending on the case, an arbitrary adhesive layer may be provided on the support in the side where the backcoat layer is provided, so that the support can be imparted with adhesive property.

For the matting agent which is preferably added to the backcoat layer, an organic or inorganic fine particle can be used. Examples of the organic matting agent include a fine particle of radical polymerization polymer such as polymethyl methacrylate (PMMA), polystyrene, polyethylene and polypropylene, and a fine particle of condensed polymer such as polyester and polycarbonate.

The backcoat layer is preferably provided in a coated amount of approximately from 0.5 to 5 g/m$^2$. If the coated amount is less than 0.5 g/m , the coatability is unstable and problems such as powder-falling of the matting agent are readily caused, whereas if it exceeds 5 g/m$^2$, the particle size of the suitable matting agent becomes very large and the image receiving layer surface is embossed by the backcoat during storage, as a result, missing or uneven formation of a recorded image is liable to result particularly in the thermal transfer of transferring a thin-film image forming layer.

The matting agent preferably has a number average particle size 2.5 to 20 $\mu$m larger than the film thickness of the backcoat layer comprising only a binder. In the matting agent, particles having a particle size of 8 $\mu$m or more must be present in a proportion of 5 mg/m$^2$ or more, preferably from 6 to 600 mg/m$^2$. By containing the matting agent as such, the foreign matter failure can be improved. Also, by using a matting agent having a narrow particle size distribution such that the value ($\delta$/rn (=coefficient of variation in the particle size distribution)) obtained by dividing the standard deviation of the particle size distribution by the number average particle size is 0.3 or less, the defect encountered in the case of using particles having an extremely large particle size can be improved and moreover, a desired performance can be obtained with a smaller amount added. This coefficient of variation is preferably 0.15 or less.

In the backcoat layer, an antistatic agent is preferably added so as to prevent the adhesion of foreign matters due to frictional electrification with a transportation roll. Examples of the antistatic agent which can be used include cationic surfactants, anionic surfactants, nonionic surfactants, polymer antistatic agents, electrically conducting fine particles and compounds over a wide range described in 11290 *no Kagaku Shohin* (11290 *Chemical Products*), Kagaku Kogyo Nippo Sha, pp. 875–876.

Among these substances as the antistatic agent which can be used in combination in the backcoat layer, preferred are metal oxides such as carbon black, zinc oxide, titanium oxide and tin oxide, and electrically conducting fine particles such as organic semiconductor. In particular, the electrically conducting fine particle is preferred because the antistatic agent does not dissociate from the backcoat layer and the antistatic effect can be stably obtained independently of the environment.

In the backcoat layer, various activators or release agents such as silicone oil and fluororesin may be added so as to impart coatability or releasability.

The backcoat layer is particularly preferred when the cushion layer and the image receiving layer each has a softening point of 70° C. or less as measured by TMA (thermomechanical analysis).

The TMA softening point is determined by elevating the temperature of an object to be measured at a constant temperature-rising rate while applying a constant load, and observing the phase of the object. In the present invention, the temperature where the phase of the object to be measured starts changing is defined as the TMA softening point. The measurement of the softening point by TMA can be performed using an apparatus such as Thermoflex manufactured by Rigaku Denki Sha.

In the image formation, the thermal transfer sheet and the image receiving sheet can be used as a laminate obtained by superposing the image forming layer of the thermal transfer sheet on the image receiving layer of the image receiving sheet.

The laminate of the thermal transfer sheet and the image receiving sheet can be formed by various methods. For example, the laminate can be easily obtained by superposing the image forming layer of the thermal transfer sheet and the image receiving layer of the image receiving sheet and passing these sheets between pressure and heating rollers. In this case, the heating temperature is preferably 160° C. or less, or 130° C. or less.

Another suitable method for obtaining the laminate is the above-described vacuum contact method. The vacuum contact method is a method where an image receiving sheet is first wound around a drum having provided thereon a suction hole for vacuumization and then, a thermal transfer sheet having a slightly larger size than the image receiving sheet is vacuum-contacted with the image receiving sheet while uniformly expelling the air by a squeeze roller. Other than this, a method where an image receiving sheet is mechanically attached to a metal drum while pulling the image receiving sheet and further thereon, a thermal transfer sheet is mechanically attached similarly while pulling the thermal transfer sheet, thereby contacting these sheets, may also be used. Among these methods, a vacuum contact method is preferred because the temperature of heat roller and the like needs not be controlled and the layers can be rapidly and uniformly stacked with ease.

The present invention is described in greater detail by referring to the Examples, however, the present invention should not be construed as being limited thereto. In the Examples, unless otherwise indicated, the "parts" means "parts by weight".

EXAMPLE 1

Manufacture of Thermal Transfer Sheet C (Cyan):

1) Preparation of Coating Solution for Light-to-heat Conversion Layer:

The components shown below were mixed while stirring with a stirrer to prepare a coating solution for light-to-heat conversion layer.

[Composition of Coating Solution for Light-to-Heat Conversion Layer]

| | |
|---|---|
| Infrared light-absorbing dye ("NK-2014" produced by Nippon Kanko Shikiso Co., Ltd.) | 7.6 parts |
| Compound 1 (polymer mordant) | 5.5 parts |
| Polystyrene (produced by Aldrich) | 30 parts |
| N,N-Dimethylformamide | 1,500 parts |
| Methyl ethyl ketone | 360 parts |
| Surfactant ("Megafac F-177" produced by Dainippon Ink & Chemicals Inc.) | 0.5 parts |
| Matting agent ("SEAHOSTER KEP150", silica gel particle, produced by Nippon Shokubai) | 1.7 parts |

Compound 1

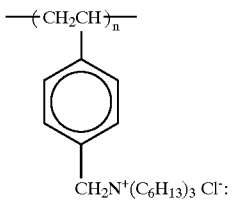

2) Formation of Light-to-Heat Conversion Layer on the Surface of Support

On one surface (center line average roughness: 0.04 μm) of a polyethylene terephthalate film (support) having a thickness of 75 μm and a width of 65 cm, the coating solution for light-to-heat conversion layer was coated using a wire bar and then, the coating was dried for 2 minutes in an oven at 120° C. to form a light-to-heat conversion layer on the support. The obtained light-to-heat conversion layer had absorption near the wavelength of 808 nm. The absorbance (optical density: OD) was measured by UV-visible region spectrophotometer UV-2400 manufactured by Shimadzu Seisakusho and found to be OD=0.9. The cross-section of the light-to-heat conversion layer was observed through a scanning electron microscope and the layer thickness was found to be 0.3 μm on average.

3) Preparation of Coating Solution for Cyan Image Forming Layer

The components shown below were charged into a mill of a kneader and a dispersion pretreatment was performed by adding a shear force while adding a slight amount of a solvent. To the obtained dispersion, a solvent was further added to finally have the following composition, and the resulting solution was dispersed in a sand mill for 2 hours to obtain a cyan pigment dispersion mother solution (i.e., tank solution).

[Composition of Cyan Pigment Dispersion Mother Solution]

| | |
|---|---|
| Polyvinyl butyral ("Eslec B BL-SH", produced by Sekisui Chemical Co., Ltd.) | 12.6 parts |
| Pigment (cyan pigment (Pigment Blue 15, "#700-10 FG CY-Blue") | 15.0 parts |
| Dispersant ("PW-36", produced by Kusumoto Kasei) | 0.8 parts |
| n-Propyl alcohol | 110 parts |

Then, the components shown below were mixed while stirring with a stirrer to prepare a coating solution for a cyan image forming layer.

[Composition of Coating Solution for Cyan Image Forming Layer]

| | |
|---|---|
| Cyan pigment dispersion mother solution prepared above | 118 parts |
| Polyvinyl butyral ("Eslec B BL-SH", produced by Sekisui Chemical Co., Ltd.) | 5.2 parts |
| Wax-based compounds: | |
| (Stearic acid amide, "NEWTRON 2", produced by Nippon Seika) | 1.0 part |
| (Behenic acid amide, "DIAMID BM", produced by Nippon Kasei) | 1.0 part |
| (Lauric acid amide, "DIAMID Y", produced by Nippon Kasei) | 1.0 part |
| (Palmitic acid amide, "DIAMID KP", produced by Nippon Kasei) | 1.0 part |
| (Erucic acid amide, "DIAMID L-200", produced by Nippon Kasei) | 1.0 part |
| (Oleic acid amide, "DIAMID 0-200", produced by Nippon Kasei) | 1.0 part |
| Rosin ("KE-311", produced by Arakawa Kagaku) | 2.8 part |
| Pentaerythritol tetraacrylate ("NK Ester A-TMMT", Shin Nakamura Kagaku) | 1.7 parts |
| Surfactant ("Megafac F-176P", solid content: 20%, produced by Dainippon Ink & Chemicals Inc.) | 1.7 parts |
| n-Propyl alcohol | 890 parts |
| Methyl ethyl ketone | 247 parts |

The particles in the thus-obtained coating solution for a cyan image forming layer were measured by a particle size distribution meter employing a laser scattering system, as a result, it was found that the average particle size was 0.25 μm and the particles of 1 μm or more occupied 0.5%.

4) Formation of Cyan Image Forming Layer on the Surface of Light-to-Heat Conversion Layer On the light-to-heat conversion layer formed above, the coating solution for a cyan image forming layer prepared above was coated by a wheeler over 1 minute and then, the coating was dried for 2 minutes in an oven at 100° C. to form a cyan image forming layer on the light-to-heat conversion layer. In this way, a thermal transfer sheet C comprising a support having provided thereon a light-to-heat conversion layer and a cyan image forming layer in this order was manufactured.

The optical density (optical density: OD) of the cyan image forming layer of the thermal transfer sheet C was measured by a Macbeth densitometer "TD-904" (W filter) and found to be OD=0.91. Also, the thickness of the cyan image forming layer was measured and found to be 0.45 μm on average.

Manufacture of Image Receiving Sheet:

A composition for a cushiony interlayer and a coating solution for image receiving layer were prepared each to have the following composition.

1) Coating Solution for Cushiony Interlayer

| | |
|---|---|
| Vinyl chloride-vinyl acetate copolymer ("MPR-TSL", produced by Nisshin Kagaku) | 20 parts |
| Plasticizer ("PARAPLEX G-40", produced by CP. HALL. COMPANY) | 10 parts |
| Surfactant ("Megafac F-177", produced by Dainippon Ink & Chemicals Inc.) | 0.5 parts |
| Antistatic agent ("SAT-5 Supper (IC)), produced by Wako Pure Chemical Industries, Ltd.) | 0.3 parts |
| Methyl ethyl ketone | 60 parts |
| Toluene | 10 parts |
| N,N-Dimethylformamide | 3 parts |

2) Coating Solution for Image Receiving Layer

| | |
|---|---|
| Polyvinyl butyral ("Eslec B BL-SH", produced by Sekisui Chemical Co., Ltd.) | 8 parts |
| Antistatic agent ("SANSTAT 2012A", produced by Sanyo Chemical Industries Co., Ltd.) | 0.7 parts |
| Surfactant ("Megafac F-177", produced by Dainippon Ink & Chemicals Inc.) | 0.1 parts |
| n-Propyl alcohol | 20 parts |
| Methanol | 20 parts |
| 1-Methoxy-2-propanol | 50 parts |

The coating solution for the formation of a cushiony interlayer prepared above was coated on a white PET support ("LUMIRROR E-58", produced by Toray Industries, Inc., thickness: 130 μm) using a small-width coating machine and then, the coated layer was dried. Thereafter, the coating solution for an image receiving layer was coated and dried. The coating solutions were controlled such that after the drying, the cushiony interlayer had a thickness of about 20 μm and the image receiving layer had a thickness of about 2 μm. The manufactured material was taken up into a roll form and after storage at room temperature for 1 week, used for image recording by laser light.

Formation of Transferred Image:

The image receiving sheet (56 cm×79 cm) manufactured above was wound around a 25 cm-diameter rotary drum having punched thereon vacuum section holes (plane density: 1 hole per area of 3 cm×8 cm) having a diameter of 1 mm and vacuum-adsorbed. Subsequently, the thermal transfer sheet C (cyan) prepared above and cut into 61 cm×84 cm was superposed to uniformly protrude from the image receiving sheet and contact-laminated while squeezing by a squeeze roller to allow the air to be suctioned through the section holes. The decompression degree was −150 mmHg (about 81.13 kPa) to 1 atm. in the state where the section holes were closed. On the drum rendered rotating, semiconductor laser rays at a wavelength of 808 nm were irradiated from the outside and converged to form a spot of 7 μm on the surface of the light-to-heat conversion layer and while moving the spot (sub-scanning) in the direction right-angled to the rotary direction (main scanning direction) of the rotary drum, a laser image (image and line) was recorded on the laminate. The laser irradiation conditions are as shown below. The laser beam used in this Example had a multi-beam dimensional arrangement comprising parallelograms forming 5 lines in the main scanning direction and 3 lines in the sub-scanning direction.

| | |
|---|---|
| Laser power: | 110 mW |
| Main-scanning speed | 6 m/sec |
| Sub-scanning pitch | 6.35 μm |

After the completion of laser recording, the laminate was removed from the drum and the thermal transfer sheet C was manually peeled off from the image receiving sheet, as a result, it was confirmed that only the light-irradiated region of the image forming layer of the thermal transfer sheet C was transferred to the image receiving sheet from the thermal transfer sheet C.

EXAMPLE 2

A thermal transfer sheet C was manufactured in the same manner as in Example 1 except that in the composition of the coating solution for the light-to-heat conversion layer, 5.5 parts of Compound 2 (polymer mordant) and 30 parts of Ethyl Cellulose N-7 (produced by Herakles) were added in place of adding 5.5 parts of Compound 1 (polymer mordant) and 30 parts of polystyrene. Using this thermal transfer sheet C and an image receiving sheet, a transferred image was formed in the same manner as in Example 1.

Compound 2

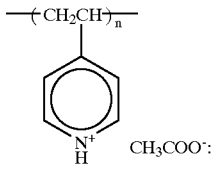

EXAMPLE 3

A thermal transfer sheet C was manufactured in the same manner as in Example 1 except that in the composition of the coating solution for the light-to-heat conversion layer, 5.5 parts of Compound 3 (polymer mordant) and 30 parts of SARAN Resin F216 (produced by Asahi Chemical Industry Co., Ltd., main component: a copolymer of vinylidene chloride and acrylonitrile (polymerization ratio: 91/9)) were added in place of adding 5.5 parts of Compound 1 (polymer mordant) and 30 parts of polystyrene. Using this thermal transfer sheet C and an image receiving sheet, a transferred image was formed in the same manner as in Example 1.

Compound 3

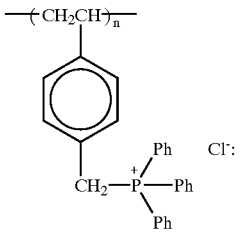

COMPARATIVE EXAMPLE 1

A thermal transfer sheet C was manufactured in the same manner as in Example 1 except that in the composition of the coating solution for the light-to-heat conversion layer, 30 parts of DIANAL BR83 (produced by Mitsubishi Rayon Company Limited, main component: polymethyl methacrylate) were added in place of adding 5.5 parts of Compound 1 (polymer mordant) and 30 parts of polystyrene. Using this thermal transfer sheet C and an image receiving sheet, a transferred image was formed in the same manner as in Example 1.

Evaluation of Transferred Image

The transferred images of Examples 1 to 3 and Comparative Example 1 were evaluated as follows.

1) Evaluation of Sensitivity

Each transferred image was observed through an optical microscope, as a result, the laser-irradiated area was linearly recorded. The width of this recorded line was measured and the sensitivity was determined according to the following formula:

$$\text{Sensitivity (mJ/cm}^2\text{)}=(\text{laser power P (mW)})/(\text{line width d (cm)}\times\text{linear velocity (cm/s)})$$

2) Evaluation of Film Fogging

The recorded image formed for the evaluation of sensitivity was observed with an eye (through an optical microscope) and evaluated by the following ranking.

○: No film fogging.

Δ: Film fogging was partially generated.

×: Film fogging was generated on the entire surface.

The evaluation results are shown in Table 1.

TABLE 1

| | Binder of Light-to-Heat Conversion Layer | SP Value (Hoy's method) of Binder in Light-to-Heat Conversion Layer | Difference from SP Value (Okitsu's method) of Image Forming Layer | Sensitivity (mJ/cm$^2$) | Film Fogging |
|---|---|---|---|---|---|
| Example 1 | polystyrene | 21.888 | 1.78 | 367 | ○ |
| Example 2 | Ethyl Cellulose N-7 | 24.652 | 3.58 | 313 | ○ |
| Example 3 | SARAN Resin F216 | 21.654 | 4.17 | 280 | ○ |
| Comparative Example 1 | DIANAL BR83 | 19.402 | 0.92 | 455 | Δ |

It is seen from the results in Table 1 that when the thermal transfer sheet of the present invention is used, the image forming layer and the underlying layer thereof can be stably separated at the time of transferring the image onto the image receiving sheet and therefore, a transferred image free of film fogging and having good sensitivity can be obtained.

EXAMPLE 4

A thermal transfer sheet C was manufactured in the same manner as in Example 1 except that the coating solution for the light-to-heat conversion layer had the following composition. The image receiving sheet was manufactured in the same manner as in Example 1.

Coating Solution for Light-to-Heat Conversion Layer

| | |
|---|---|
| Infrared absorbing dye (NK2014, produced by Nippon Kanko Shikiso) | 10 parts |
| Cellulose diacetate (produced by Daicel Chemical Industries, Ltd.) | 40 parts |
| N-Methyl-2-pyrrolidone | 2000 parts |
| Methyl ethyl ketone | 480 parts |
| Matting agent ("SEAHOSTER KEP150", produced by Nippon Shokubai) | 2 parts |
| Surfactant ("Megafac F-176P", produced by Dainippon Ink & Chemicals Inc.) | 1 part |

Formation of Transferred Image:

The image receiving sheet manufactured above was wound around a 38 cm-diameter rotary drum having punched thereon vacuum section holes having a diameter of 1 mm and vacuum-adsorbed. Subsequently, the thermal transfer sheet prepared above was superposed to uniformly protrude from the image receiving sheet and contact-laminated while squeezing by a squeeze roller to allow the air to be suctioned through the section holes. While rotating the drum to give a linear velocity of 10 m/s, recording was performed using a laser having a wavelength of 808 nm and an output of 100 mW. Thereafter, the recorded image on the image receiving sheet was transferred to art paper using a laminator.

EXAMPLE 5

A thermal transfer sheet C was manufactured in the same manner as in Example 4 that 40 parts of PVP15 (produced by Gokyo Sangyo, main component: polyvinyl-pyrrolidone) was used in place of 40 parts of cellulose diacetate in the coating solution for light-to-heat conversion layer in Example 4 and the coating solution for cyan image forming layer was coated on a 75 μm-thick polyethylene terephthalate support. Using this thermal transfer sheet C and the image receiving sheet, a transferred image was formed in the same manner as in Example 4.

COMPARATIVE EXAMPLE 2

A thermal transfer sheet C was manufactured in the same manner as in Example 4 that 40 parts of DIANAL BR83 (produced by produced by Mitsubishi Rayon Company Limited, main component: polymethyl methacrylate) was used in place of 40 parts of cellulose diacetate in the coating solution for light-to-heat conversion layer in Example 4. Using this thermal transfer sheet C and the image receiving sheet, a transferred image was formed in the same manner as in Example 4.

Evaluation of Transferred Image:

In the same manner as above, 1) evaluation of sensitivity and 2) evaluation of film fogging were performed.

3) Absorbance

The absoption spectrum of the sample provided on the support with the light-to-heat conversion layer was measured by spectrophotometer UV-2100 (manufactured by Shmadzu Seisakusho). The absorbance was a value at 808 nm of laser wavelength.

4) Evaluation of Transfer Density

As for the transfer density of the transferred image finally obtained on art paper using each thermal transfer sheet C, the cyan transfer density was measured using a reflection densitometer X-Rite (manufactured by X-Rite).

The evaluation results are shown in Table 2.

TABLE 2

| | Binder of Light-to-Heat Conversion Layer | SP Value (Hoy' method) of Binder in Light-to-Heat Conversion Layer | Difference from SP Value (Okitsu' method) of Binder of Image Forming Layer | Sensitivity (mJ/cm$^2$) | Film Fogging | Absorbance | Transfer Density |
|---|---|---|---|---|---|---|---|
| Example 4 | cellulose diacetate | 24.024 | 2.86 | 322 | ○ | 1.03 | 1.442 |
| Example 5 | PVP15 | 21.648 | 4.95 | 319 | ○ | 0.91 | 1.456 |
| Comparative Example 2 | DIANAL BR83 | 19.402 | 0.92 | 455 | Δ | 0.76 | 1.292 |

As apparent from the results of Table 2, it is revealed that when a transferred image is formed using the thermal transfer sheet of the present invention, film fogging was not generated, the sensitivity is high and the transferred image had high transfer density.

According to the present invention, a thermal transfer sheet is provided, where the image forming layer and the underlying layer thereof can be stably separated at the time of transferring an image onto an image receiving sheet and therefore, a transferred image free of film fogging and having high sensitivity and high transfer density can be obtained.

While the invention has been described in detail and with reference to specific embodiments thereof, it will be apparent to one skilled in the art that various changes and modifications can be made therein without departing from the spirit and scope thereof.

What is claimed is:

1. A thermal transfer sheet comprising a support having provided thereon at least a light-to-heat conversion layer containing a light-to-heat conversion substance, and an image forming layer in this order, wherein the absolute value of the difference in the solubility parameter (SP values) obtained by Okitsu' method between the binder in the image forming layer and the binder contained in the underlying layer thereof is 1.5 or more.

2. The thermal transfer sheet as claimed in claim 1, wherein said light-to-heat conversion layer contains a water-insoluble light-to-heat conversion substance and a binder and said binder has a solubility parameter (SP value) obtained by Hoy's method of 19.5 to 24.5.

3. The thermal transfer sheet as claimed in claim 1, wherein an interlayer is provided between said light-to-heat conversion layer and said image forming layer.

4. The thermal transfer sheet as claimed in claim 1, wherein said image forming layer contains a pigment and an amorphous organic high molecular polymer having a softening point in the temperature range of from 40 to 150° C. as a binder each in an amount of 20 to 80% by weight and has a thickness of 0.2 to 1.5 μm.

5. The thermal transfer sheet as claimed in claim 1, wherein said light-to-heat conversion layer contains at least one polymer mordant together with said light-to-heat conversion substance.

6. The thermal transfer sheet as claimed in claim 1, wherein said light-to-heat conversion substance gives a maximum absorbance at a wavelength of 700 to 1,200 nm in the light-to-heat conversion layer.

7. The thermal transfer sheet as claimed in claim 1, wherein said light-to-heat conversion substance is an infrared absorbing dye.

8. The thermal transfer sheet as claimed in claim 7, wherein said infrared absorbing dye is a cyanine dye.

9. The thermal transfer sheet as claimed in claim 1, wherein the recording is performed at a scanning speed of 7 m/s or more using a laser having an output of 50 mW or more.

* * * * *